US011069182B2

(12) United States Patent
Maddux

(10) Patent No.: US 11,069,182 B2
(45) **Date of Patent: *Jul. 20, 2021**

(54) GAMING SYSTEM AND METHOD IN WHICH BASE GAME PLAY AFFECTS FEATURE GAME OUTCOME

(71) Applicant: Aristocrat Technologies Australia Pty Limited, North Ryde (AU)

(72) Inventor: Bretton Maddux, Henderson, NV (US)

(73) Assignee: Aristocrat Technologies Australia Pty Limited, North Ryde (AU)

( * ) Notice: Subject to any disclaimer, the term of this patent is extended or adjusted under 35 U.S.C. 154(b) by 0 days.

This patent is subject to a terminal disclaimer.

(21) Appl. No.: 16/905,509

(22) Filed: Jun. 18, 2020

(65) Prior Publication Data

US 2020/0320823 A1 Oct. 8, 2020

Related U.S. Application Data

(63) Continuation of application No. 15/824,079, filed on Nov. 28, 2017, now Pat. No. 10,733,833.

(51) Int. Cl.
*G07F 17/32* (2006.01)

(52) U.S. Cl.
CPC ..... *G07F 17/3213* (2013.01); *G07F 17/3209* (2013.01); *G07F 17/3244* (2013.01)

(58) Field of Classification Search
CPC ..... G07F 17/3244; G07F 17/3209; G07F 17/3213
USPC ..... 463/20
See application file for complete search history.

(56) References Cited

U.S. PATENT DOCUMENTS

| | | | |
|---|---|---|---|
| 4,492,378 | A | 1/1985 | Williams |
| 5,184,821 | A | 2/1993 | Korenek |
| 5,188,363 | A | 2/1993 | Marnell, II |
| 5,839,955 | A | 11/1998 | Mangano |
| 6,342,007 | B1 | 1/2002 | Wood |
| 7,399,226 | B2 | 7/2008 | Mishra |
| 7,618,316 | B2 | 11/2009 | Cole |
| 8,246,437 | B2 | 8/2012 | Haag |
| 8,408,990 | B2 | 4/2013 | De Waal |
| 10,332,357 | B2 | 6/2019 | Berman |

(Continued)

FOREIGN PATENT DOCUMENTS

| | | | |
|---|---|---|---|
| KR | 100779759 | B1 | 11/2007 |
| KR | 20070109538 | A | 11/2007 |

OTHER PUBLICATIONS

IGT Wheel Poker Deluxe, 1 page.

(Continued)

*Primary Examiner* — Jay Trent Liddle
*Assistant Examiner* — Ryan Hsu
(74) *Attorney, Agent, or Firm* — McAndrews, Held & Malloy, Ltd.

(57) ABSTRACT

A gaming system having a base game and a feature game. The feature game includes a rotatable circular poker wheel having a plurality of display areas. Each of the display areas of the wheel are populated with playing cards during the play of the base game. A special symbol in the base game outcome allows population and revision of the cards on the poker wheel. Upon a trigger condition occurring, the wheel is rotated and stopped at a position to select a card from which a poker hand of five playing cards is formed.

20 Claims, 20 Drawing Sheets

(56) References Cited

U.S. PATENT DOCUMENTS

| | | | | |
|---|---|---|---|---|
| 10,810,827 | B2 * | 10/2020 | Grace | G07F 17/3267 |
| 2002/0065126 | A1 * | 5/2002 | Miller | G07F 17/3244 463/20 |
| 2004/0204228 | A1 | 10/2004 | Walker | |
| 2005/0288088 | A1 | 12/2005 | Englman | |
| 2007/0057452 | A1 | 3/2007 | Dargue | |
| 2010/0016062 | A1 | 1/2010 | Baerlocher | |
| 2011/0059789 | A1 | 3/2011 | Luciano | |
| 2012/0122545 | A1 * | 5/2012 | Watkins | G07F 17/3211 463/20 |
| 2015/0087378 | A1 * | 3/2015 | Louie | G07F 17/3267 463/17 |
| 2015/0087403 | A1 | 3/2015 | Castro | |
| 2018/0025590 | A1 | 1/2018 | Ballone | |

OTHER PUBLICATIONS

David Currie, "Wheel Poker Deluxe—South Point." YouTube online video, https://www.youtube.com/watch?v=KXS7P06cvWI (last accessed May 1, 2019).

Notice of Allowance dated Mar. 23, 2020, for U.S. Appl. No. 15/824,079 (pp. 1-5).

* cited by examiner

GAMING SYSTEM AND METHOD IN WHICH BASE GAME PLAY AFFECTS FEATURE GAME OUTCOME

RELATED APPLICATION(S)

The present application is a continuation of U.S. patent application Ser. No. 15/824,079, filed Nov. 28, 2017, which is hereby incorporated by reference in its entirety.

FIELD

The present invention relates to gaming and wagering, and more specifically to two game play in which a first game affects the outcome of a second game.

BACKGROUND

Electronic gaming machines ("EGMs") provide a variety of wagering games such as slot games, video poker games, roulette games, keno games and other types of games that are frequently offered at casinos and other locations for use by players. Play on EGMs typically involve a player placing a wager on outcomes of a primary game. On many such EGMs, secondary games or bonus rounds are also available after the player qualifies by attaining a certain winning combination or event on or related to the primary game. Once qualified, the player then enters the secondary game or bonus round where they are given an opportunity to win extra game credits, game tokens or other awards. In the case of 'game credits' that are awarded during base play or bonus play, the credits are typically added to a credit meter total on the EGM and provided to the player upon completion of a gaming session when the player "cashes out."

Secondary games, often referred to as feature games, can also offer altered game play from the primary games, often referred to as base games, to enhance player enjoyment of the particular gaming system.

Also, in existing gaming systems, some players enjoy the use of their skill and mental reasoning in connection with the play of gaming systems. Such a use of skill is typically not found in feature game play.

In addition, in existing electronic gaming machines, the base game is a game separate and apart from the game played as a feature game.

The need exists for new gaming systems and alternative methods to provide feature games in gaming systems, and for a larger variety of types of feature games, in order to increase player enjoyment of two game play of both a base game and a feature game.

Thus, what is needed are improved systems, apparatus, and methods for two game play.

It is therefore an object of the present invention to increase player enjoyment of play of a gaming system having two games.

It is a further object of the present invention to provide for skill and mental reasoning in connection with the play of gaming systems having two games, as for example, a base game and a feature game.

It is a further object of the present invention to cause interaction between the base game and the feature game so as to increase player enjoyment.

All references cited herein are incorporated in their entirety by reference.

BRIEF SUMMARY

These and other objects of the present invention are achieved in a gaming system, method and apparatus having two game play, for example, a base game play and a feature game play. Play of the base game has an effect on the play of the feature game. In addition, in some embodiments, the player's level of skill has an effect on the outcome of play of the feature game. Further, in some embodiments, the player interacts with the game display, adding more excitement to the play.

In some embodiments, a gaming system using a display is provided to present both a base game and a feature game for viewing by the player. The base game has a plurality of different base game symbol outcomes, and awards are determined based on such outcomes. In addition, the base game play provides for change in the feature game.

In some embodiments, a gaming method using a display having two display areas is provided. A feature game is displayed in one display area and includes a rotatable circular wheel having a plurality of card areas. Each of the card areas of the wheel is populated with a playing card visible to the player, during the play of the base game in another display area of the display. Upon a trigger condition occurring, the wheel is rotated on the display and stopped at a position to select a card from which a poker hand of five playing cards is formed. A prize of credits is awarded in accordance with the stopping position of the wheel after it is spun.

In an embodiment, there is an initial population of cards onto the wheel and some wheel areas are left unpopulated.

In yet other embodiments a gaming apparatus having a player interface permits the player to interact with the display in order to populate more cards onto the feature wheel, to remove cards from the feature wheel and to change card positions on the wheel.

Still other features, aspects, and advantages of embodiments will become more fully apparent from the following detailed description, the appended claims, and the accompanying drawings illustrating a number of example embodiments and implementations, including the best mode contemplated for carrying out the embodiments. Embodiments may also be capable of other and different applications, and several details may be modified in various respects, all without departing from the spirit and scope of the disclosed embodiments. Accordingly, the drawings and descriptions are to be regarded as illustrative in nature, and not as restrictive. The drawings are not necessarily drawn to scale.

BRIEF DESCRIPTION OF THE DRAWINGS

Embodiments of the disclosure will now be described with reference to the accompanying drawings in which.

DETAILED DESCRIPTION OF THE PREFERRED EMBODIMENT

Figure 1:
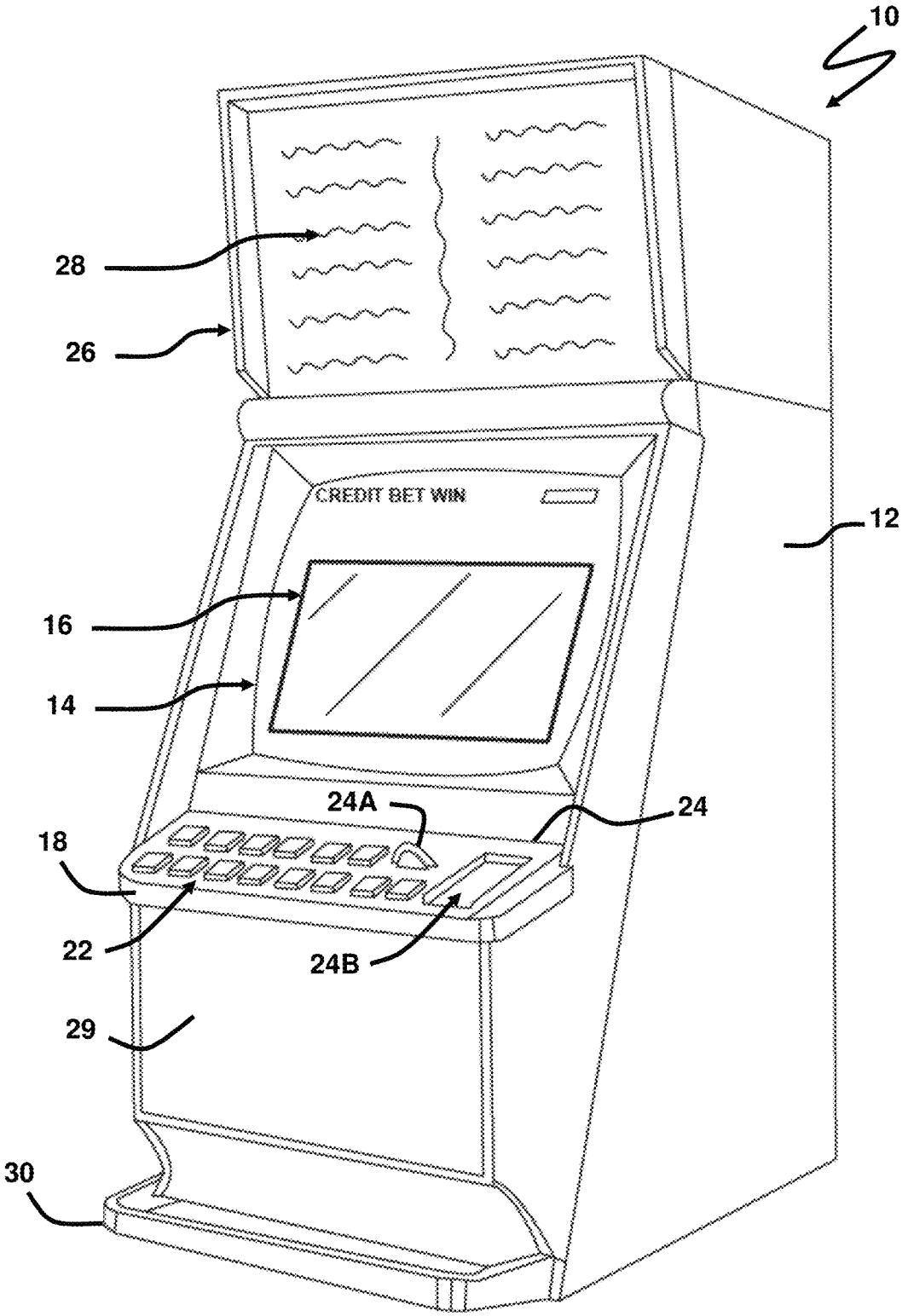
FIG. 1 is a perspective view depicting an example of a standalone gaming machine according to some embodiments.

Embodiments disclosed herein describe a gaming system and devices that enable two game play in which a first game is used by a player to affect the outcome of a second game that is played later.

A gaming system in the form of a standalone gaming machine comprises a display on which a base game and a feature game are displayed for play by a player. The base game has a plurality of different symbol outcomes, and awards are determined based on such outcomes. In addition, a feature game is displayed which includes a rotatable circular wheel having a plurality of card areas. Each of the card areas is populated with a playing card during the play of the base game. Upon a trigger condition, the wheel is rotated on the display and stopped to select a card from which a poker hand of five playing cards is developed. A prize of credits is awarded in accordance with the poker hand. A player interface permits the player to interact with the display in order to populate more cards onto the feature wheel, to remove cards from the feature wheel and to change card positions on the wheel.

The above description is merely an illustrative example of some embodiments of the invention and numerous additional features and aspects of the invention are disclosed below.

The drawbacks of the prior art are overcome by the embodiments described herein which allow for two game play in which the first game provides for change in the second game. Some embodiment provide for player interaction using the player's skill to prepare the characteristics of the second game in order to achieve a larger potential win.

With these and other advantages and features of the invention that will become hereinafter apparent, the nature of the invention may be more clearly understood by reference to the following detailed description, the appended claims and to the several drawings included herein. In the following description, reference is made to the accompanying drawings that form a part hereof, and in which is shown, by way of illustration, specific embodiments in which the invention may be practiced. These embodiments are described in sufficient detail to enable those skilled in the art to practice the invention, and it is to be understood that other embodiments may be utilized and that structural, logical, software, hardware, and electrical changes may be made without departing from the scope of the present invention. The following description is, therefore, not to be taken in a limited sense, and the scope of the present invention is defined by the appended claims.

Terms

Throughout the description that follows and unless otherwise specified, the following terms may include and/or encompass the example meanings provided in this section. These terms and illustrative example meanings are provided to clarify the language selected to describe embodiments of the invention both in the specification and in the appended claims.

The term "game" may refer to a gambling event with a beginning and end that may encompass one or more spins, handle pulls, or span of time. The end of the game may be determined voluntarily (in which the player elects to stop play) or involuntarily (in which the gaming device terminates play).

The term "primary game" or "base game" may refer to play resulting from the spinning of standard physical or graphical slot reels, the dealing of physical or electronic cards, or other game outcomes.

The term "secondary game" or "feature game" may refer to a game separate from the primary game in which the player typically does not have to wager any additional funds or credits and has the possibility of winning a relatively large payout. It should be understood that in some embodiments, a feature game may require an additional wager.

The term "outcome" may refer to a result of a gaming event, such as cherry-cherry-cherry in a slot machine game. Others will be apparent to those of skill in the art based on the present disclosure.

The term "payout" may refer to a prize, reward, winnings, or bonus associated with a certain outcome.

The term "game controller" may refer to a circuit within a gaming device that includes a processor that processes game play instructions in accordance with game play rules and outputs game play outcomes to one or more displays. The game play rules may be stored as program code in a memory but can also be hardwired. In some embodiments, the memory may also store data indicative of a plurality of symbols, pay tables, images, and/or other information to be used in games.

The term "processor" when described as part of, or existing within a game controller, may refer generically to any device that can process game play instructions in accordance with game play rules and may include: a microprocessor, microcontroller, programmable logic device or other computational device, a general purpose computer (e.g. a PC) or a server. That is, a processor may be provided by any suitable logic circuitry for receiving inputs, processing them in accordance with instructions stored in memory and generating outputs (for example on the display). Such processors are sometimes also referred to as central processing units (CPUs). Most processors are general purpose units, however, it is also known to provide a specific purpose processor using, for example, an application specific integrated circuit (ASIC) or a field programmable gate array (FPGA).

The term "slot machine" may refer to a gaming device or any mechanical, electrical or other device, contrivance or machine which, upon insertion of any monetary value in the form of a bill, a coin, ticket, token or similar object, or upon payment of any consideration, is available to play or operate, the play or operation of which, whether by reason of the skill of the operator in playing a gambling game which is presented for play by the machine or application of the element of chance, or both, may deliver or entitle the person playing or operating the machine to receive cash, premiums, merchandise, tokens, tickets, or anything of value, whether the payoff is made automatically from the machine or in any other manner.

The term "wagering credit" may refer to a representation of value, other than a chip, token or wagering instrument, that is used for wagering at a game, gaming device, etc., and is obtained by the payment of cash or a cash equivalent, the use of a wagering instrument or the electronic transfer of money.

The term "wagering instrument" may refer to a representative of value, other than a chip or token, that is issued by a casino or other establishment for use in a cashless wagering system.

Details of Gaming System, Gaming Machine and Method

Referring to FIG. 1, a gaming system in the form of a standalone gaming machine 10 includes a console 12 having a display 14 on which are displayed representations of a game 16 that can be played by a player.

Figure 2:
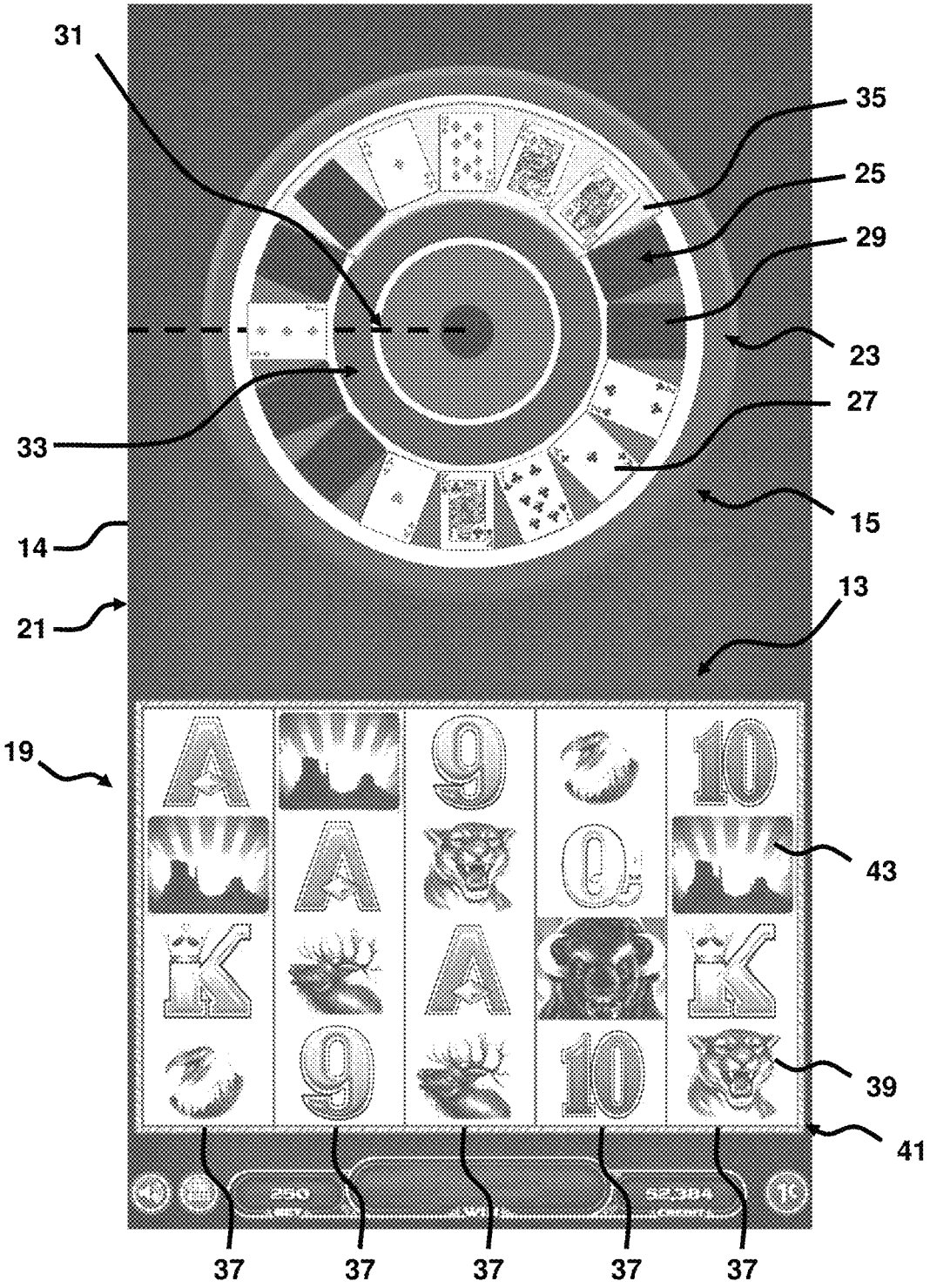
FIG. 2 is a first view of a base game and feature wheel shown on the display of the gaming machine of FIG. 1.

As shown more fully in FIG. 2, display 14 is operable to display both a base game, generally indicated by reference numeral 13, and a feature game, generally indicated by reference numeral 15. Display 14 includes a first display area 19 for play of the base game and a second display area 21 for play of the feature game. Feature game 15 includes a circular wheel 23 which is spun and stopped for play of the feature game.

As shown in FIG. 2, wheel 23 is comprised of a number of wheel areas 25, some of which are populated with a face-up playing card 27 and some of which are blank wheel areas 29. In the embodiment shown in FIG. 2, wheel 23 has sixteen wheel areas 25. Each of the sixteen areas 25 are located on a separate radius 31 of the wheel and are evenly spaced around an inner circumference 33 of the wheel. Thus, up to sixteen cards may occupy sixteen wheel areas 25.

Play of the feature game involves the rotation and stopping of wheel 23 in order to select five cards to form a poker hand for the player. The selection of cards is based on the stopping position of wheel 23 relative to an indicator 35. Indicator 35 is located at the top of the wheel and surrounds five wheel areas, and is fixed in its position on display 14. Indicator 35 is of a different color, e.g., green, than the color of the wheel, e.g., brown, so that the indicator is quickly perceived by the player.

As wheel 23 spins, indicator 35 maintains its position, and wheel 23 is seen moving below indicator 35. The wheel stops in a position such that five wheel areas 25 are indicated, i.e., seen within indicator 35. As shown in FIG. 2, the five wheel areas indicated by indicator 35 have four (4) playing cards 27 and one (1) blank area 29. An award is determined based on the developed poker hand within indicator 35.

Base game 13 is played in first display area 19 located below feature wheel 23. The base game has five reels 37 which are spun and then stopped to play the base game. Upon stopping of reels 37, a base game outcome is displayed, including twenty game symbols 39 in a 4×5 symbol array 41. Each game symbol 39 is located in a single symbol display position 43 of array 41.

To initiate play of the base game, the player establishes a credit balance, makes a wager (and may select a number of pay lines) and activates a play button, for example. Gaming machine 10 responds and initially moves a number of cards, e.g., ten cards, onto feature wheel 23 and into ten wheel areas 25, as shown in FIG. 2. The initial ten cards are randomly selected by the game controller (described hereinafter) and are positioned randomly in ten of the sixteen wheel areas 25. Such a population of the wheel preferably occurs prior to the spin of the five reels 37 for play of the base game.

Figure 3:
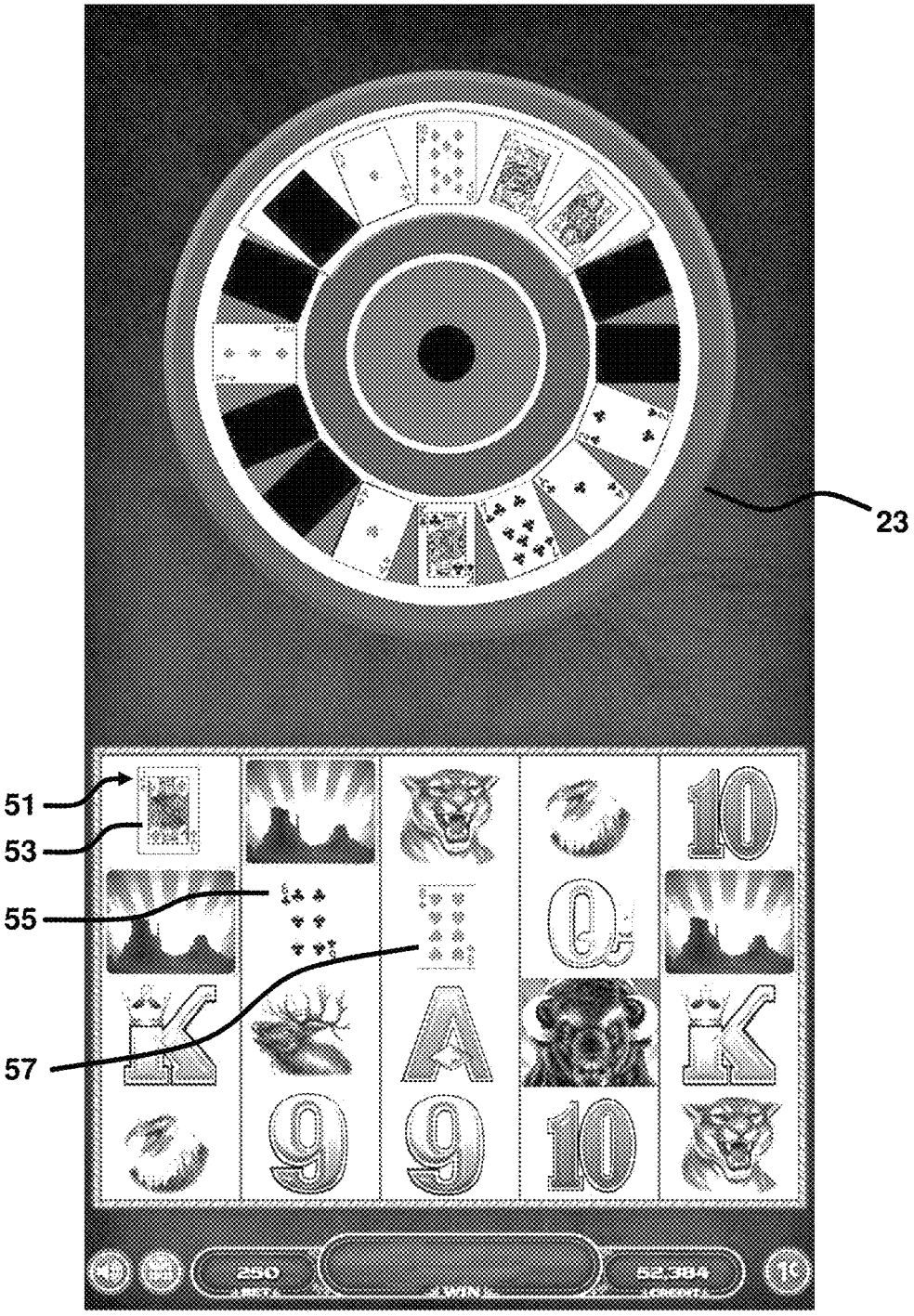
FIG. 3 is a second view of the base game and feature wheel shown on the display of the gaming machine of FIG. 1.

Referring to FIG. 3, after feature wheel 23 is initially populated with playing cards, base game reels 37 are activated to first spin and then stop to provide a base game outcome, for example, the outcome shown in FIG. 3. Feature wheel 23 is not spun, but maintains its position. Any winning pay lines in the outcome of reels 37 will cause an award to be made to the player.

In addition, one or more special symbols 51 may occur in the base game outcome. For example, three special symbols 51 occur in the outcome shown in FIG. 3. Special symbols 51 include a Jack of Diamonds card 53, a "6" of Clubs card 55 and an "8" of Hearts card 57. Special symbol 51 is a face-up playing card, but may take on other forms in order to identify a single playing card. Further, special symbols 51 may serve as WILD symbols, for example, in determining a base game award based on an outcome of reels 37.

Figure 4:
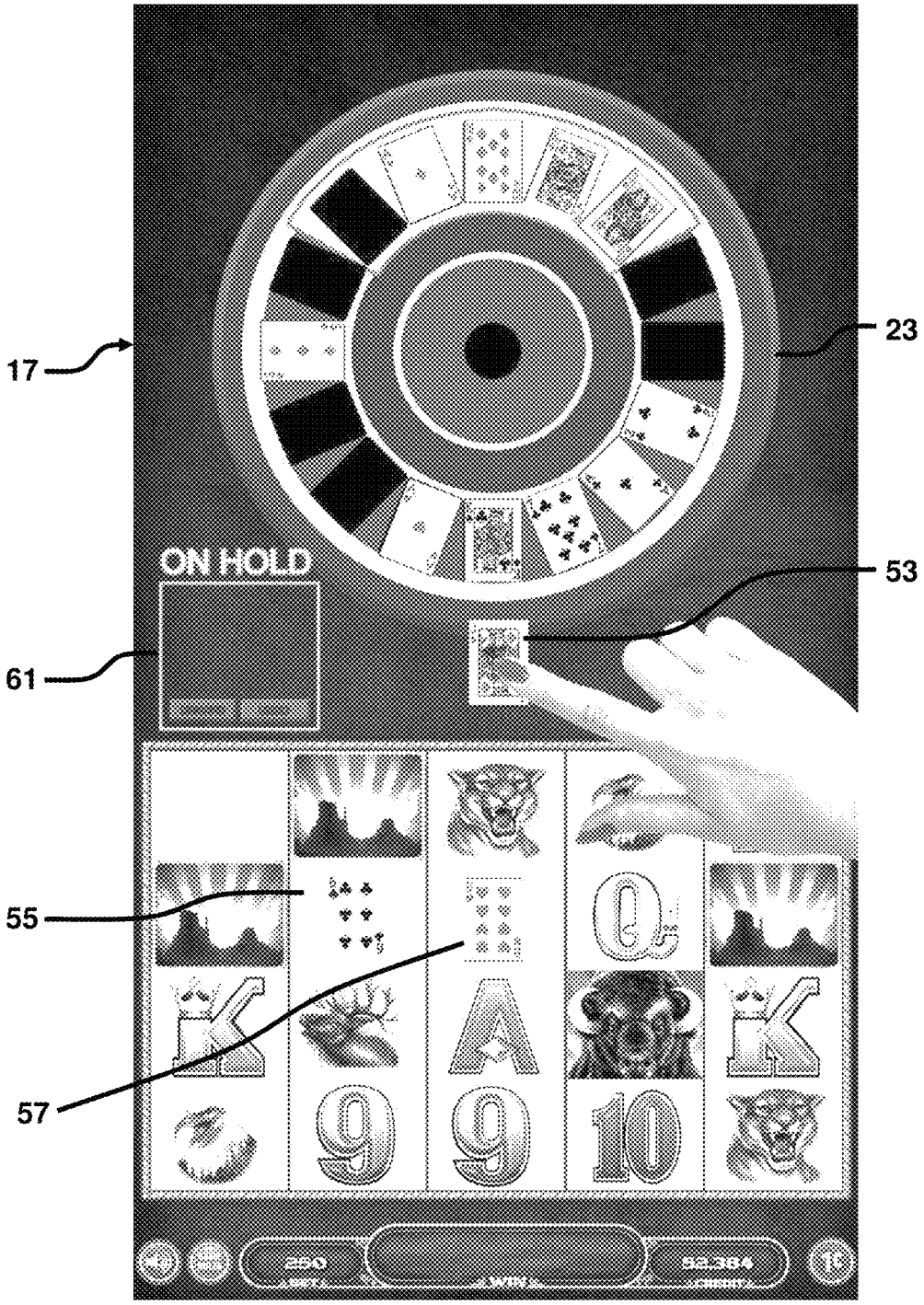
FIG. 4 is a third view of the base game and feature wheel showing an ON HOLD area on the display of the gaming machine of FIG. 1 and showing player interaction.

Referring now to FIG. 4, when a special symbol 51 spins up in the base game outcome, the player may move the special symbol, for example card 53, onto a blank area of wheel 23. To do so, the player touches the display screen surface of display 17, and drags card 53 onto the wheel, as shown in FIGS. 4 and 5.

In addition, after the spin up of a base game outcome having special symbols, or as the card 53 begins to be dragged across the display, a card hold area 61 is displayed on display 14. Card hold area 61 is placed adjacent wheel 23 on the display, as shown. Card hold area 61 is shaped as a square box of a size within which a playing card, e.g., card 53, will fit. The box is labeled with the words "ON HOLD."

Figure 5:
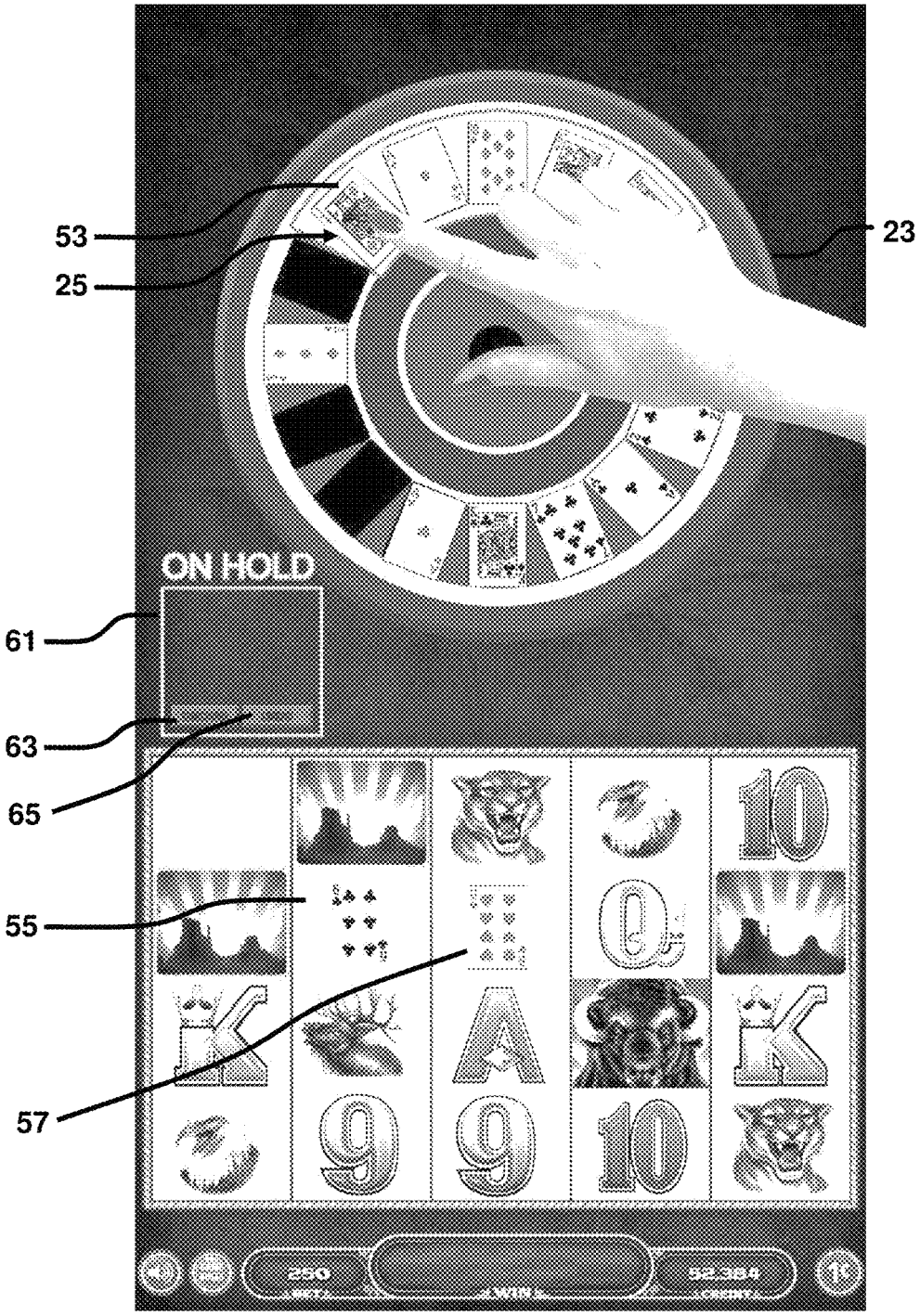
FIG. 5 is a fourth view of the base game and feature wheel showing player interaction.

Referring to FIG. 5, the player chooses the particular wheel area where card 53 will be placed. The player drags card 53 (the Jack of Diamonds) to the blank area on wheel 23 adjacent to the Ace of Diamonds. Card 53 will be caused to align to the specific wheel area as the card is moved onto the wheel area 25 and released by removal of the player's finger from the card 53.

As understood, there is skill involved in the selection of the particular wheel area 25 where the card is to be placed. The placement of the Jack of Diamonds card 53 is adjacent to an Ace of Diamonds, which is adjacent to a 10 of Diamonds, which is adjacent to a King of Diamonds, which is adjacent to a Queen of Diamonds, and thus provides five adjacent cards which together form a royal flush poker hand. Thus, on the spin of wheel 23, these five cards forming a royal flush have the potential to be selected based on wheel alignment with indicator 35.

Figure 6:
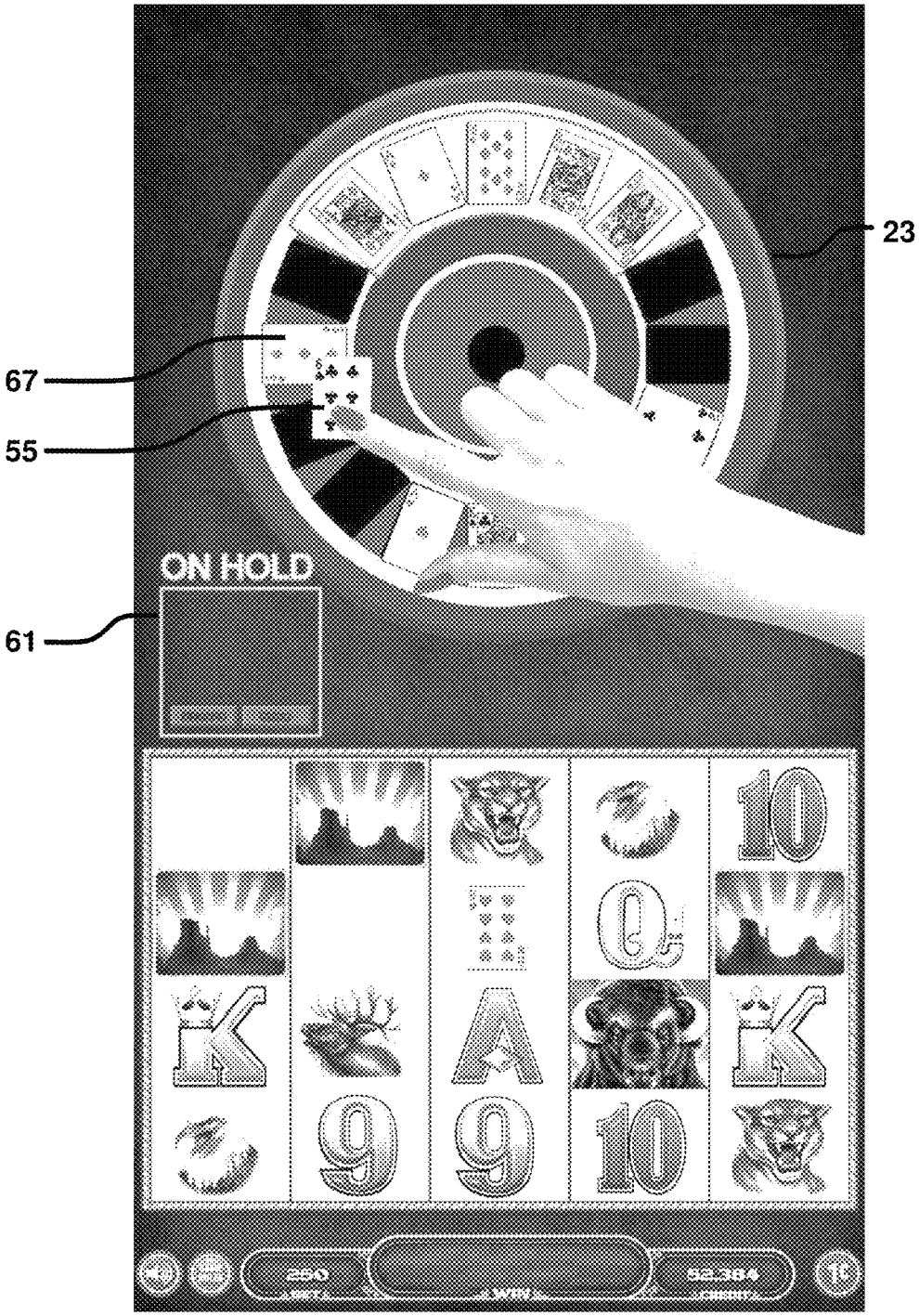
FIG. 6 is a fifth view of the base game and feature wheel showing player interaction.

Referring to FIG. 6, the player may also move a special symbol, for example card 55 (a 6 of Clubs, shown also in FIG. 5), to a wheel area already having a card, for example having a card 67 (a 3 of Diamonds, also shown in FIG. 5). Card 55 replaces card 67 on wheel 23. Similar to placement of card 53 as described above, card 55 will be caused to align to the specific wheel area (containing card 67) as card 55 is moved atop card 67 and released by removal of the player's finger from the card 55.

Figure 7:
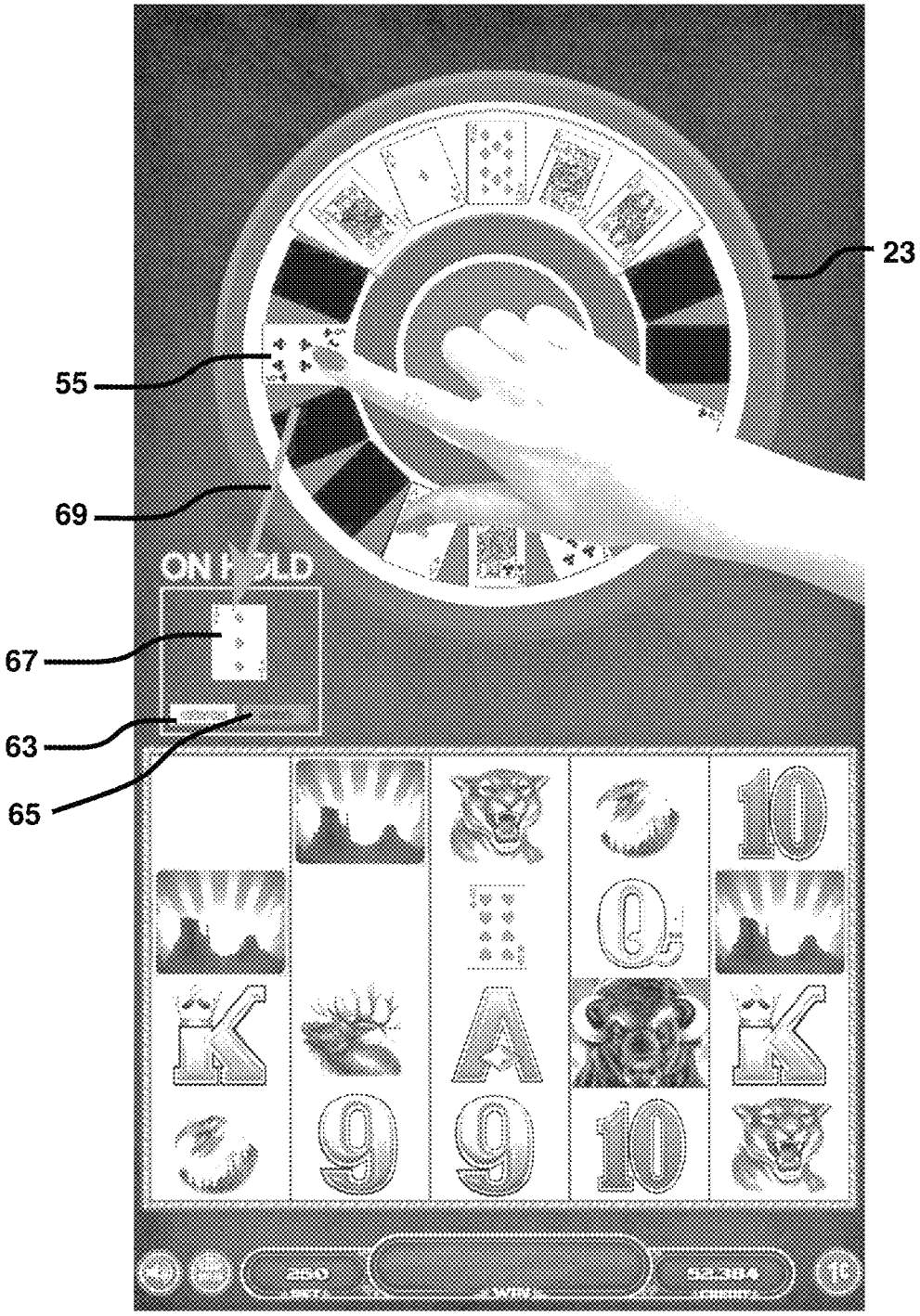
FIG. 7 is a sixth view of the base game and feature wheel showing player interaction.

Referring to FIG. 7, card 55 is dragged to align with the specific wheel area and released. Card 67 will then automatically move to the card hold area 61, as indicated by arrow 69 (arrow 69 may be displayed for a time to indicate the movement of card 67 to the player). Card 67 also may move at a speed such that the player sees the movement of card 67 happen.

Card hold area 61 includes a displayed DISCARD button 63 and a displayed UNDO button 65. As card 67 is moved to the card hold area 61, DISCARD button 63 will be enabled and preferably display of button 63 will change color to indicate its enablement to the player.

Before the player is able to move another card from the base game outcome onto wheel 23, card 67 must be moved out of the card hold area 61. The player may drag card 67 to another area on the wheel, either to a blank area or to replace another card, or the player may discard card 67 by touch actuation of DISCARD button 63. If the player drags card 67 to replace another card on wheel 23, that replaced card is likewise moved to card hold area 61; then again that replaced card must be moved out of card hold area 61 before the player is able to move another card from the base game outcome onto wheel 23.

Figure 8:
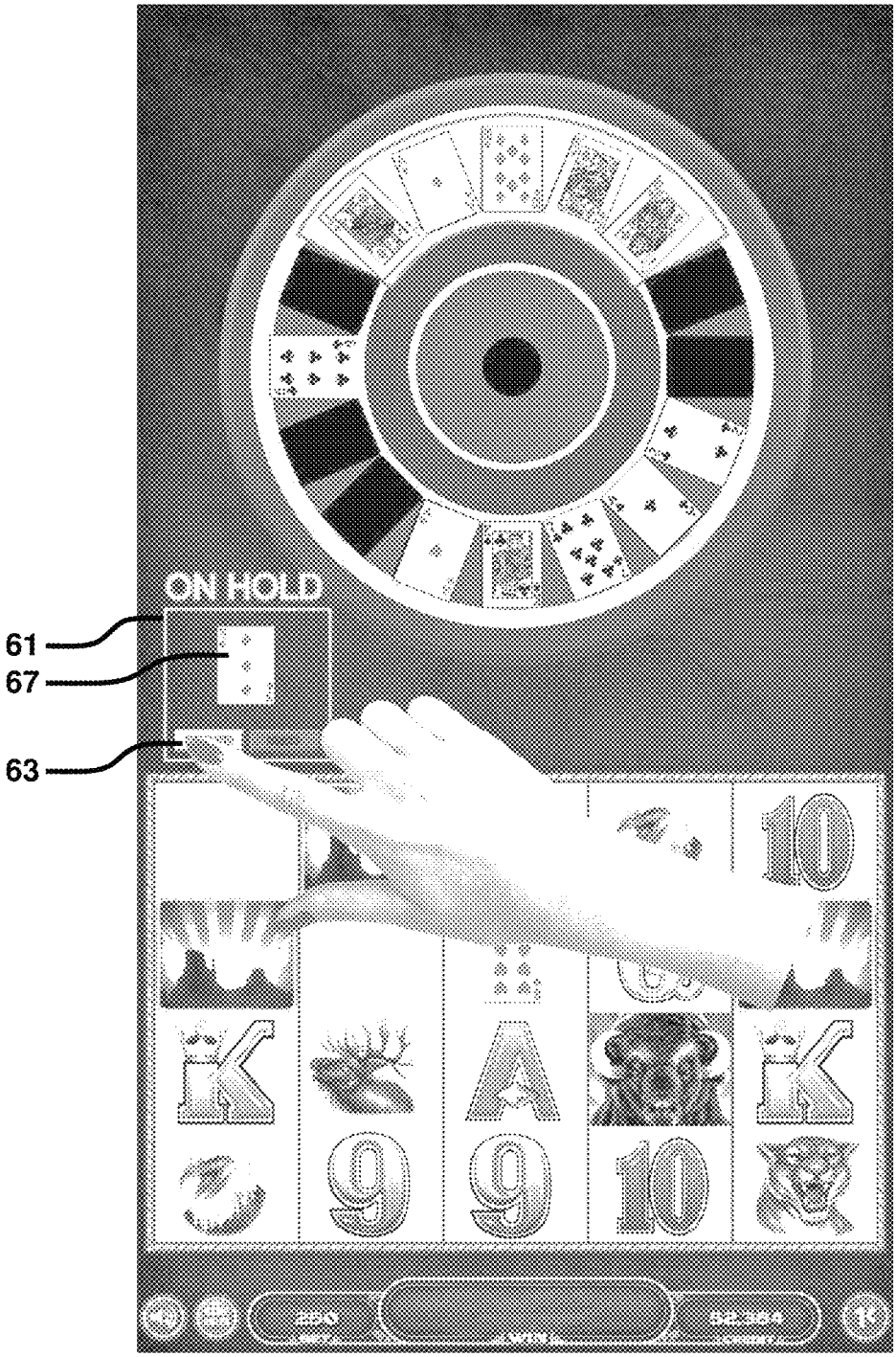
FIG. 8 is a seventh view of the base game and feature wheel showing player interaction.

As shown in FIG. 8, the player discards card 67 by touching button 63. Once DISCARD button 63 is actuated by the player, card 67 is removed from card hold area 61.

Figure 9:
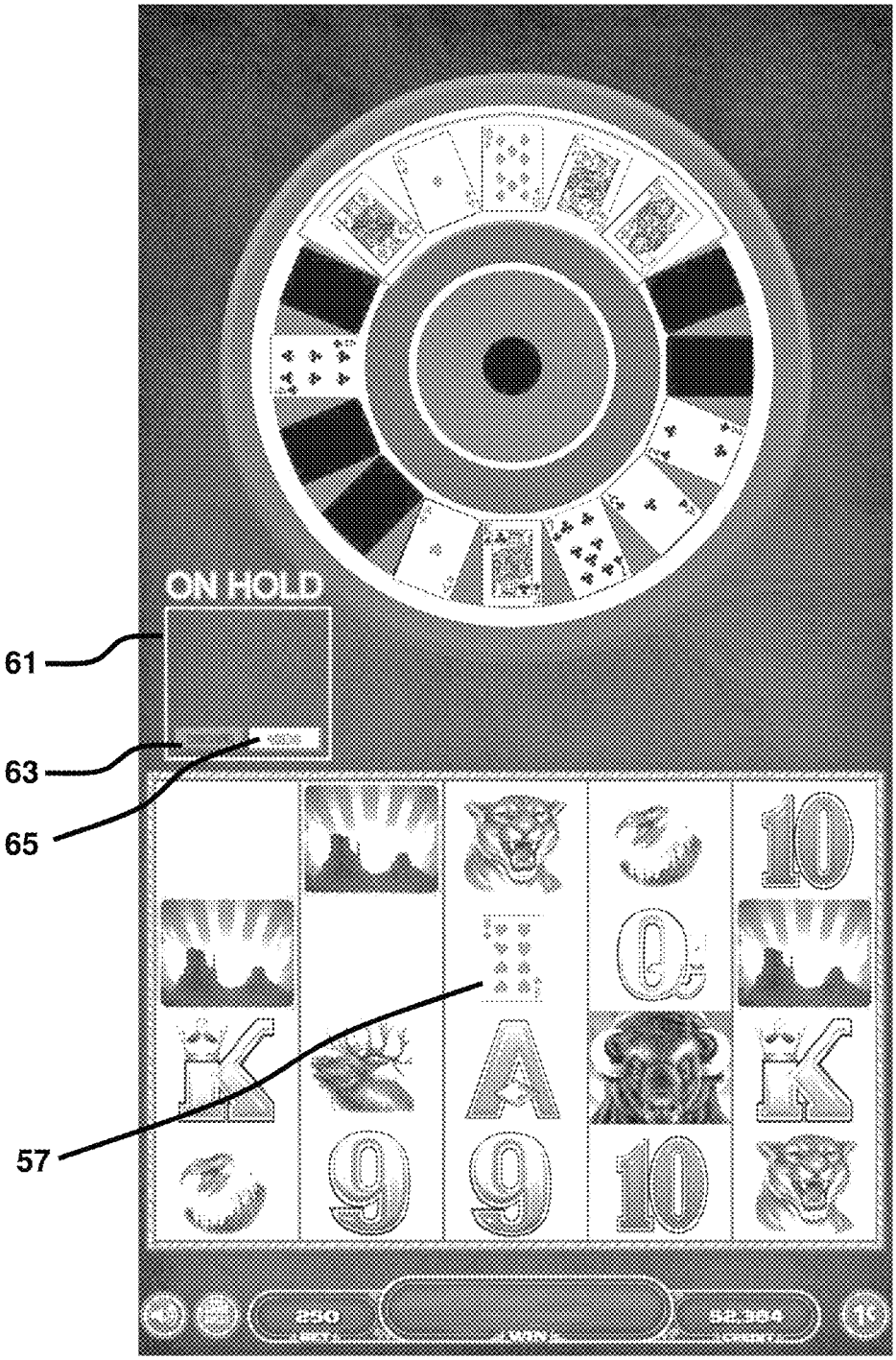
FIG. 9 is an eighth view of the base game and feature wheel.

Referring to FIG. 9, after card 67 is discarded, DISCARD button 63 is disabled and UNDO button 65 is enabled. The color of DISCARD button 63 changes and the color of UNDO button changes, to signify the state of buttons 63, 65.

UNDO button 65 may be activated by the player if the player changes his/her mind as to the prior discard action. Touching UNDO button 65 causes the discarded card 67 to be brought back to hold area 61. The player may then drag card 67 to another area on wheel 23, i.e., a blank area or to replace a card. Once the player selects the next card from the base game outcome to drag onto the wheel, the player will not be able to undo the last discard. Also, once the player spins the feature wheel 23, the player will not be able to undo the last discard.

Figure 10:
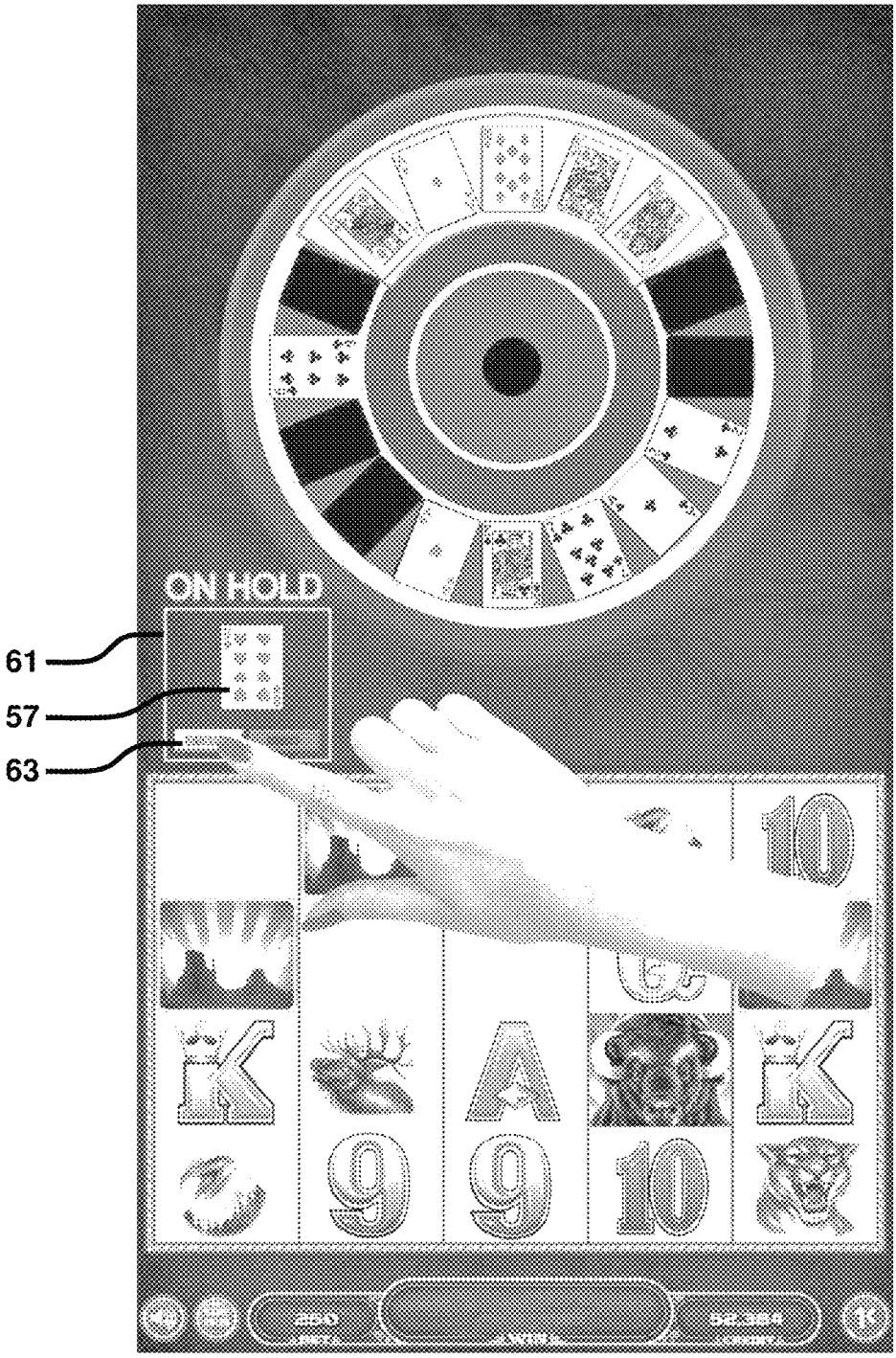
FIG. 10 is a ninth view of the base game and feature wheel showing player interaction.

The player may also discard a special symbol 51 that has spun up on a reel 37 by moving the special symbol card 51 into hold area 61 instead of moving it onto the feature wheel 23. As shown in FIG. 10, the player may move card 57 (an 8 of Hearts, shown also in FIG. 9), to hold area 61 and then touch DISCARD button 63. Card 57 will then be removed from the display 14.

The player may also change the order of the cards. To change the order of cards, the player drags a first card from a wheel area 25 onto a second card in a wheel area 25, replacing that second card with the first card. The replaced second card automatically moves to hold area 61 and the wheel area from which the first card was removed becomes blank. The second card in the hold area 61 may then be moved to the blank area where the first card was originally. Alternatively, the second card may be discarded.

Figure 11:
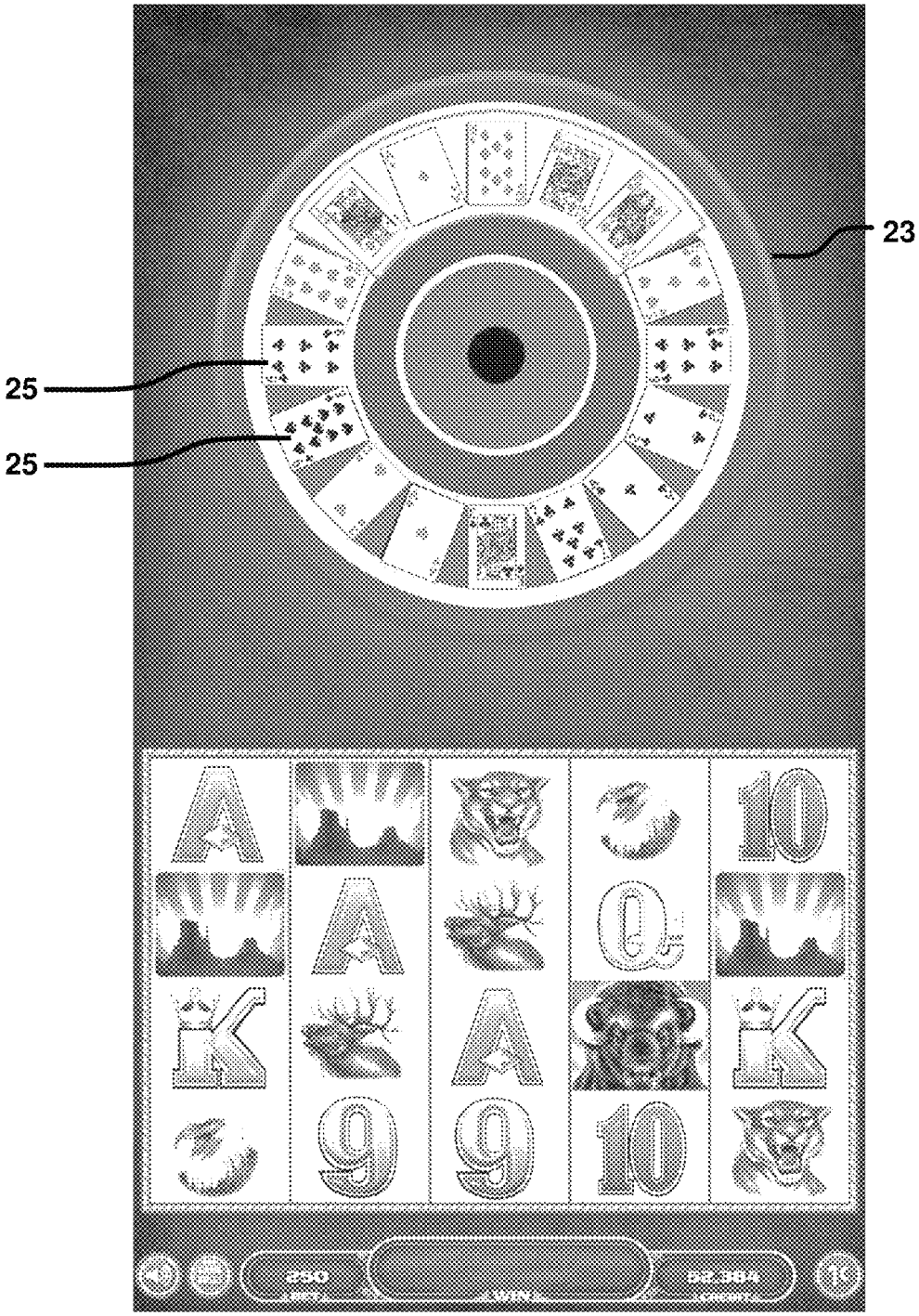
FIG. 11 is a tenth view of the base game and feature wheel of FIG. 2.

Referring to FIG. 11, the player continues to play until all of the 16 wheel areas 25 have a playing card. Upon completing the filling of the wheel, the player qualifies to spin the feature wheel to receive an award. The completing of the filling of the wheel is a trigger event which allows the feature wheel to spin to play the feature game.

Once the feature wheel is filled and the player qualified to spin the feature wheel, the wheel areas are locked and the player may not change the order of the cards on the wheel. Alternatively, prior to the spin of a filled feature wheel 23, the player may change the order of the cards. Also, prior to the spin of a filled feature wheel 23, the player may continue to play the base game and receive more special symbols (card identifiers) on base game reels 37. This allows the player to replace cards on the feature wheel to make better hands.

Figure 12:
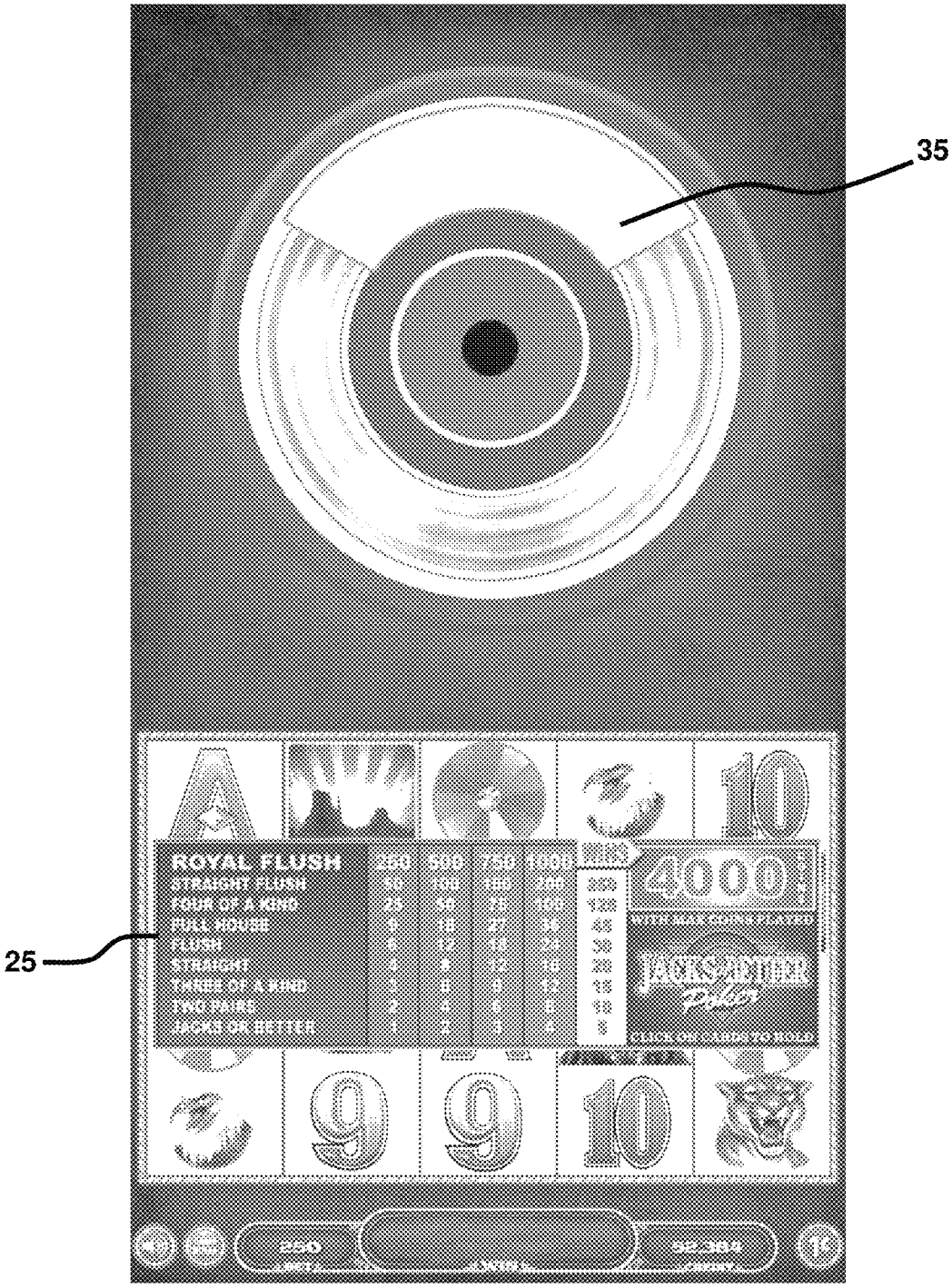
FIG. 12 is an eleventh view of the base game and feature wheel showing a representation of a spinning feature wheel and a payout table on the display of the gaming machine of FIG. 1.

Referring to FIG. 12, the player activates the spin of a filled feature wheel. After an amount of time, the wheel comes to a stop. During the spinning of the feature wheel, a poker pay table 71 appears for the player to view. Five separate columns are used, one column for each bet amount, and the corresponding amount won for each type of nine different poker hands. Pay table 71 may be displayed across the base game display area 19, as shown.

Figure 13:
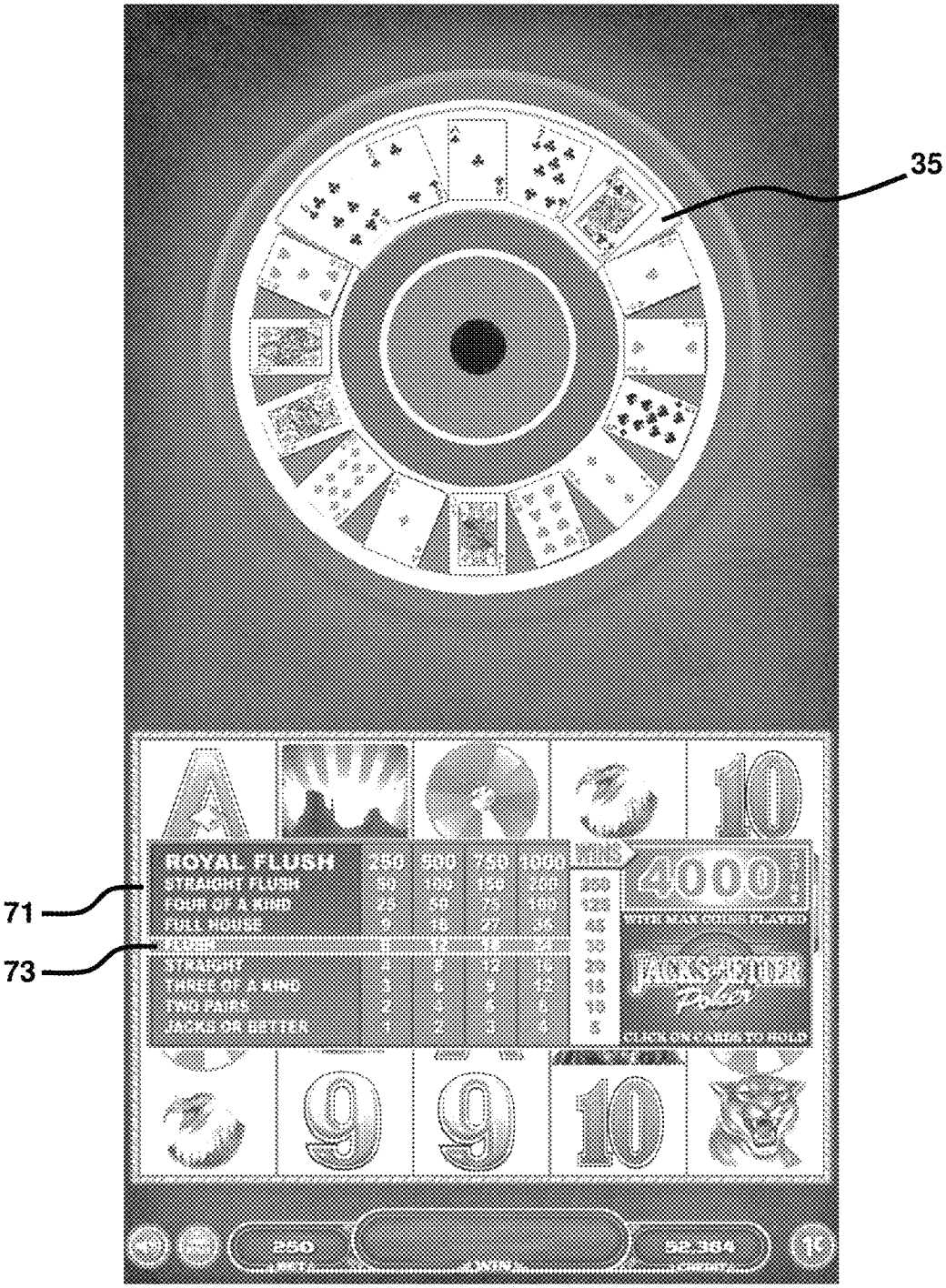
FIG. 13 is a twelfth view of the base game and feature wheel showing a payout table on the display of the gaming machine of FIG. 1.

Referring to FIG. 13, upon the stopping of the spin of feature wheel 23, indicator 35 identifies the winning five card poker hand. As shown in FIG. 13, the winning five card poker hand is a flush, i.e., a 6, 2, Ace, 7 and King of Clubs. In addition, pay table 71 includes a display of a color rectangle 73 surrounding the flush row on the pay table, and the inside area of rectangle 73 is also colored. Rectangle 73 visually identifies to the player the feature win.

Figure 14:
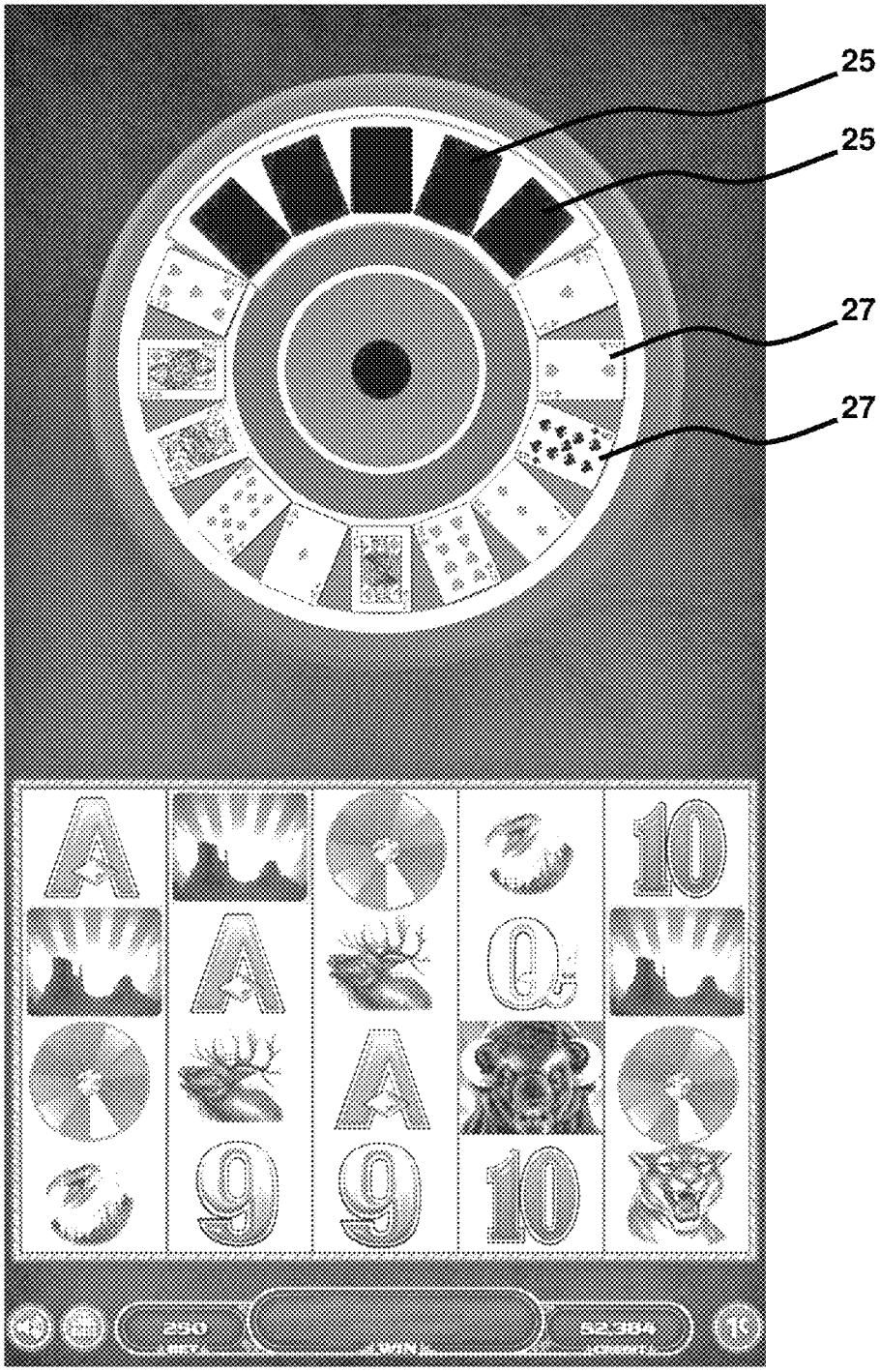
FIG. 14 is a thirteenth view of the base game and feature wheel.

Referring to FIG. 14, the winning five cards are discarded from the wheel 23 leaving five blank wheel areas 25. The player will then continue to play the base game and populate the feature wheel until all sixteen wheel areas 25 are again filled with playing cards 27.

If the player elects to stop and cash out, feature wheel 23 will be reset and all cards will be removed from the wheel. Once a player begins to play, the game will restart with a random selection of playing cards placed in randomly selected wheel areas of the feature wheel.

In an alternative embodiment, feature game 15 may be activated upon a different trigger event (different than a filling of all of the wheel areas with cards). The trigger event may, for example, occur based on a base game outcome. Once triggered, the feature game is played to achieve a feature outcome, irrespective of the number of playing cards in the wheel areas. The feature game 15 may be triggered at any time, including a time when wheel 23 still has blank wheel areas.

In an alternative embodiment, the feature outcome is determined by wheel 23 being spun relative to a fixed pointer that points to one wheel area. The card in the selected wheel area together with the four cards in adjacent wheel areas (determined clockwise from the selected wheel area) form a winning five card poker hand.

In another alternative embodiment, the feature outcome is determined by wheel 23 having four large wheel areas (not shown) with each of the four large wheel areas able to receive five cards.

In another embodiment, the feature outcome is determined by wheel 23 being spun five times and stopped each time to select five cards at pointer to form a five card poker hand. Each of the five selected wheel areas has a single card (or a vacant area) that is selected in one of the five spins of wheel 23.

In another embodiment, as a special symbol spins up in a base game outcome, a card identified by the special symbol is randomly positioned in a wheel area by action of the game controller. Alternatively, the wheel area to receive the card may be selected by the game controller based on the particular cards already displayed in the several wheel areas of the feature wheel. After all blank wheel areas have cards, another card identified in the base game outcome may replace one of the cards on wheel 23, via the game controller. The replacement may be random or else the card may replace a lower valued card if one exists on wheel 23.

In addition, the base game outcome may provide cards to the feature wheel 23 by means other than by a special symbol. For example, a base game outcome of three cherries may cause a King card to be placed onto feature wheel 23; a base game outcome of four cherries may cause an Ace card to be place on feature wheel 23.

In an alternative embodiment, feature wheel 23 may not be used. Instead, five blank cards (not shown) that remain stationary are presented in second display area 21. Each of the five blank cards change to a face-up card based on the base game outcome of, for example, a special symbol. Also, a blank card once filled with a face-up card may be replaced with another and better face-up card based on the base game outcome. Trigger of the feature game will award the five cards to the player (whether or not any are blank) to be compared to the pay table to determine whether an award has been achieved and to determine the value of the award.

The wheel areas 25 on wheel 23 may be reset to an initial set of cards or blanks. For example, after fifty (50) plays of the base game, the wheel areas 25 are reset. Also, the wheel areas 25 may be reset after the player leaves the game having removed his/her player tracking card. Also, the wheel areas 25 may be reset after a time period, e.g., five minutes without any play of the base game.

General Construction of Gaming System

The gaming system can take a number of different forms. In a first form, a standalone gaming machine is provided wherein all or most components required for implementing the game are present in a player operable gaming machine.

In a second form, a distributed architecture is provided wherein some of the components required for implementing the game are present in a player operable gaming machine and some of the components required for implementing the game are located remotely relative to the gaming machine. For example, a "thick client" architecture may be used wherein part of the game is executed on a player operable gaming machine and part of the game is executed remotely, such as by a gaming server; or a "thin client" architecture may be used wherein most of the game is executed remotely such as by a gaming server and a player operable gaming machine is used only to display audible and/or visible gaming information to the player and receive gaming inputs from the player.

However, it will be understood that other arrangements are envisaged. For example, architecture may be provided wherein a gaming machine is networked to a gaming server and the respective functions of the gaming machine and the gaming server are selectively modifiable. For example, the gaming system may operate in standalone gaming machine mode, "thick client" mode or "thin client" mode depending on the game being played, operating conditions, and so on. Other variations will be apparent to persons skilled in the art.

Figure 15:
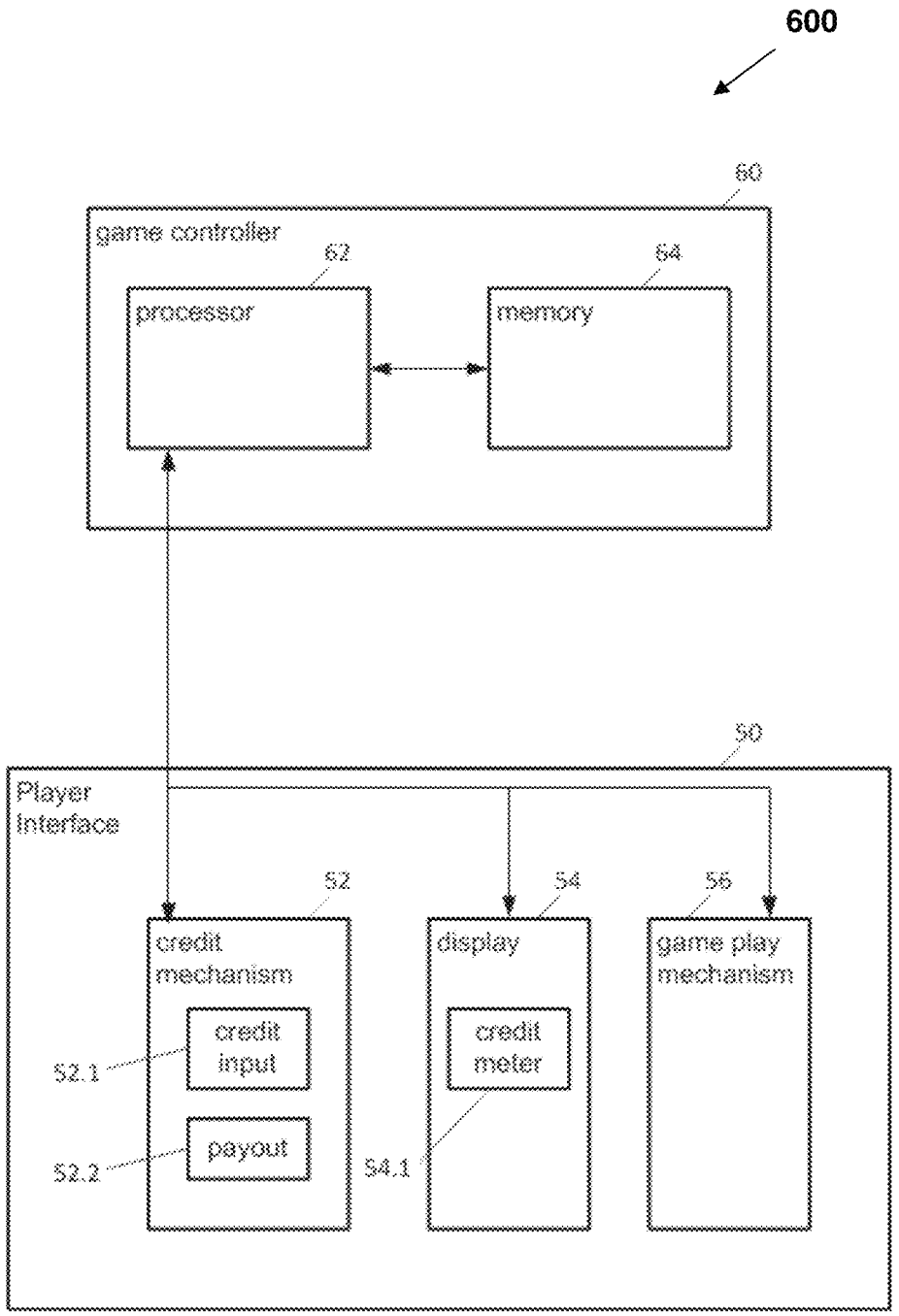
FIG. 15 is a block diagram of the core components of the gaming machine of FIG. 1.

Referring to FIG. 15, the gaming system in the form of a gaming machine 600 has several core components. At the broadest level, the core components are a player interface 50 and a game controller 60 as illustrated in FIG. 15. The player interface 50 may enable manual interaction between a player and the gaming system and for this purpose includes the input/output components required for the player to enter instructions to play the game and observe the game outcomes.

Components of the player interface may vary from embodiment to embodiment but will typically include a credit mechanism 52 to enable a player to input credits. For example, in some embodiments, the credit mechanism 52 may include a credit input mechanism 52.1 to receive a physical item representing a monetary value for establishing a credit balance. The credit balance may be increasable and decreasable based wagering activities. In accord with the established credit balance, the player places a wager and the gaming system initiates a game. In some embodiments, the credit mechanism 52 also includes a payout mechanism 52.2 to cause a payout associated with the credit balance. The player interface may also include one or more displays 54, a game play mechanism 56 including one or more input devices that enable a player to input game play instructions (e.g. to place a wager, to initiate play), and one or more speakers (not shown). In some embodiments, each of the displays 54 includes a plurality of display positions. In other embodiments, each of the displays 54 includes a plurality of display areas (for example, similar to areas 19, 21 of FIG. 2). Each of the display areas may include a plurality of display positions (for example, similar to symbol display positions 43). As shown in FIG. 15, the display 54 also includes a credit meter 54.1. In some embodiments, the credit meter 54.1 displays credits available, credits bet, and/or credits won.

The game controller 60 is in data communication with the player interface 50 and typically includes a processor 62 that processes the game play instructions in accordance with game play rules and outputs game play outcomes to the display(s) 54. Typically, the game play rules are stored as program code in a memory 64 but can also be hardwired. In some embodiments, the memory 64 may also store data indicative of a plurality of symbols, pay tables, images, and other information to be used in games. Herein the term "processor" is used to refer generically to any device that can process game play instructions in accordance with game play rules and may include: a microprocessor, microcontroller, programmable logic device or other computational device, a general purpose computer (e.g. a PC) or a server. That is, a processor may be provided by any suitable logic circuitry for receiving inputs, processing them in accordance with instructions stored in memory and generating outputs (for example on the display). Such processors are sometimes also referred to as central processing units (CPUs). Most processors are general purpose units, however, it is also know to provide a specific purpose processor using an application specific integrated circuit (ASIC) or a field programmable gate array (FPGA).

Referring again to FIG. 1, gaming machine 10 includes a mid-trim 20 which houses a bank of buttons 22 for enabling a player to interact with the gaming machine, in particular during game play. As explained above, the display may be a touch screen display to enable player interaction, as well. The mid-trim 20 also houses a credit input mechanism 24 (similar to the credit input mechanism 52.1 of FIG. 15) which in this example includes a coin input chute 24A and a bill collector 24B. Other credit input mechanisms may also be employed, for example, a card reader for reading a smart card, debit card or credit card. Other gaming machines may be configured to accept a ticket such that the credit input mechanism 24 may have a ticket reader (not shown) for reading tickets having a value and crediting the player based on the face value of the ticket. A player marketing module (not shown) having a reading device may also be provided for the purpose of reading a player tracking device, for example as part of a loyalty program. The player tracking device may be in the form of a card, flash drive or any other portable storage medium capable of being read by the reading device. In some embodiments, the player marketing module may provide an additional credit mechanism, either by transferring credits to the gaming machine from credits stored on the player tracking device or by transferring credits from a player account in data communication with the player marketing module.

A top box 26 may carry artwork 28, including for example pay tables and details of bonus awards and other information or images relating to the game. Further artwork and/or information may be provided on a front panel 29 of the console 12. The gaming machine 10 also includes a payout mechanism in the form of a coin tray 30 that is mounted beneath the front panel 29 for dispensing cash payouts from the gaming machine 10. Another form of a payout mechanism may include an embedded printer to print out a payout ticket associated with the credit balance that may be redeemed at a cage (not shown).

Display 14 shown in FIG. 1 is in the form of a liquid crystal display. Alternatively, the display 14 may be a light emitting diode display, plasma screen, and/or any other suitable video display unit. The top box 26 may also include a display, for example a video display unit, which may be of the same type as the display 14, or of a different type.

Figure 16:
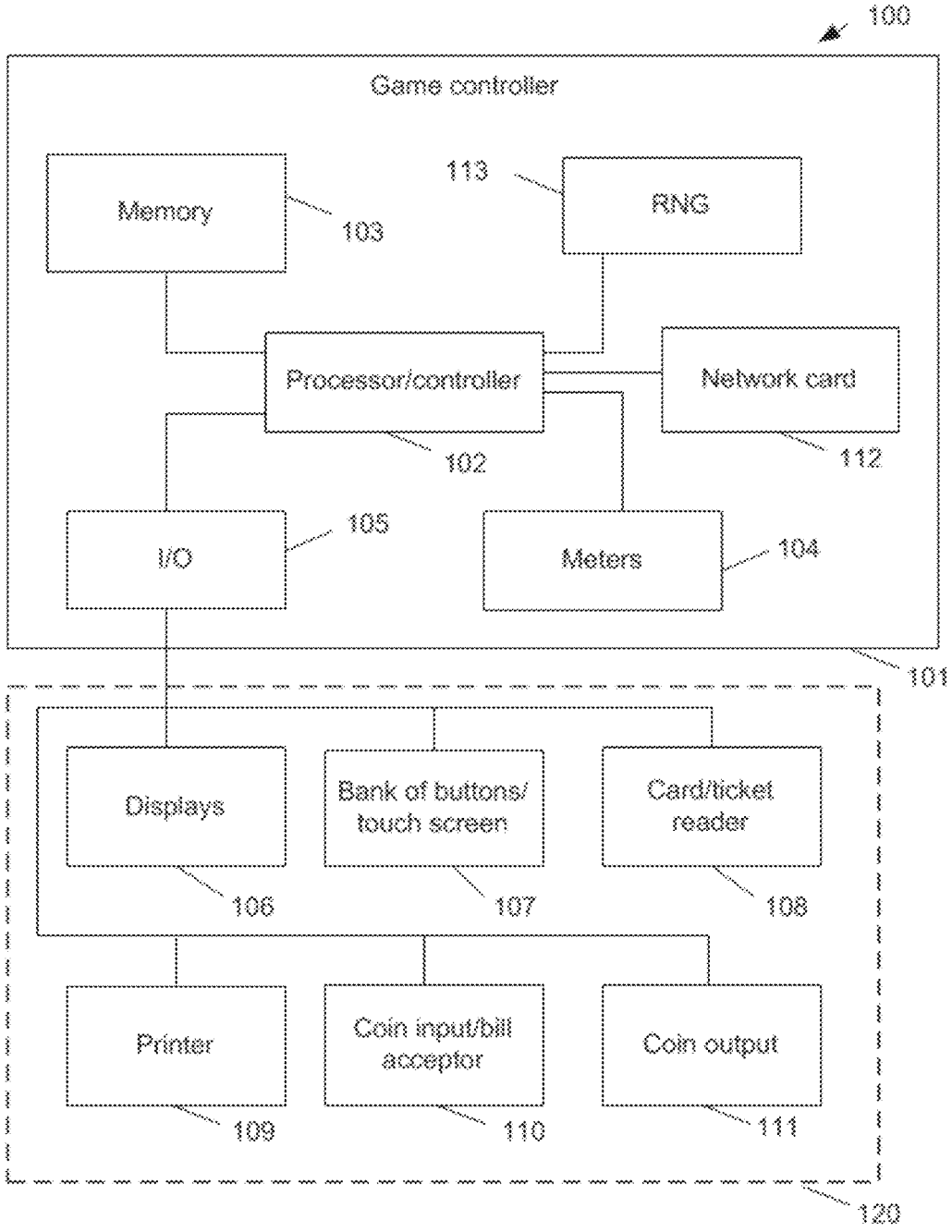
FIG. 16 is a schematic diagram of the functional components of the gaming machine of FIG. 1.

FIG. 16 shows a block diagram of operative components of a typical gaming machine 100 which may be the same as or different to the gaming machine of FIG. 1.

Gaming machine 100 of FIG. 16 includes a game controller 101 having a processor 102 mounted on a circuit board. Instructions and data to control operation of the processor 102 are stored in a memory 103, which is in data communication with the processor 102. Typically, the gaming machine 100 will include both volatile and non-volatile memory and more than one of each type of memory, with such memories being collectively represented by the memory 103.

Gaming machine 100 has hardware meters 104 for purposes including ensuring regulatory compliance and monitoring player credit, an input/output (I/O) interface 105 for communicating with peripheral devices of the gaming machine 100. Input/output interface 105 and/or the peripheral devices may be intelligent devices with their own memory for storing associated instructions and data for use with the input/output interface or the peripheral devices. A random number generator module 113 generates random numbers for use by the processor 102. Persons skilled in the art will appreciate that the reference to random numbers includes pseudo-random numbers.

In the example shown in FIG. 16, a player interface 120 includes peripheral devices that communicate with the game controller 101 including one or more displays 106, a touch screen and/or buttons 107 (which provide a game play mechanism), a card and/or ticket reader 108, a printer 109, a bill acceptor and/or coin input mechanism 110 and a coin output mechanism 111. Additional hardware may be included as part of the gaming machine 100, or hardware may be omitted as required for the specific implementation. For example, while buttons or touch screens are typically used in gaming machines to allow a player to place a wager and initiate a play of a game, any input device that enables the player to input game play instructions may be used. For example, in some gaming machines a mechanical handle is used to initiate a play of the game. Persons skilled in the art will also appreciate that a touch screen can be used to emulate other input devices, for example, a touch screen can display virtual buttons which a player can "press" by touching the screen where they are displayed.

In addition, gaming machine 100 may include a communications interface, for example a network card 112. The network card may, for example, send status information, accounting information or other information to a bonus controller, central controller, server or database and receive data or commands from the bonus controller, central controller, server or database. In embodiments employing a player marketing module, communications over a network may be via player marketing module—i.e. the player marketing module may be in data communication with one or more of the above devices and communicate with it on behalf of the gaming machine.

Figure 17:
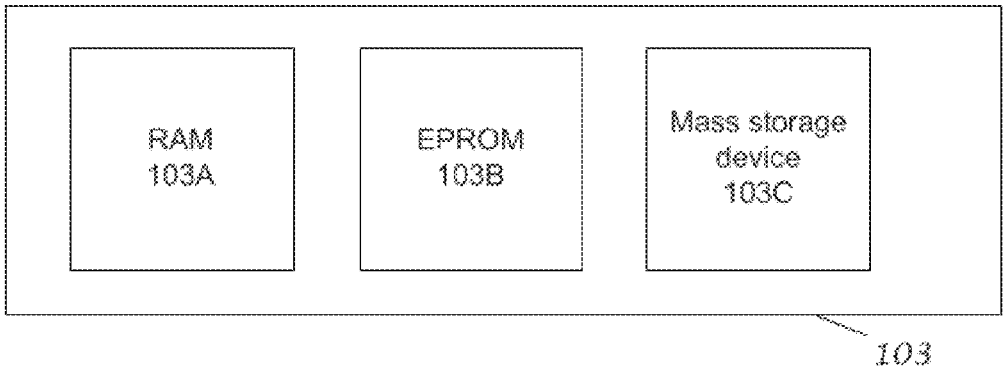
FIG. 17 is a example of functional components of a memory for use with some embodiments.

Referring now to FIG. 17 the main components of an exemplary memory 103 include RAM 103A, EPROM 103B and a mass storage device 103C. RAM 103A typically temporarily holds program files for execution by the processor 102 and related data. EPROM 103B may be a boot ROM device and/or may contain some system or game related code. Mass storage device 103C is typically used to store game programs, the integrity of which may be verified and/or authenticated by processor 102 using protected code from EPROM 103B or elsewhere.

It is also possible for the operative components of the gaming machine 100 to be distributed, for example input/output devices 106, 107, 108, 109, 110, 111 to be provided remotely from the game controller 101.

Figure 18:
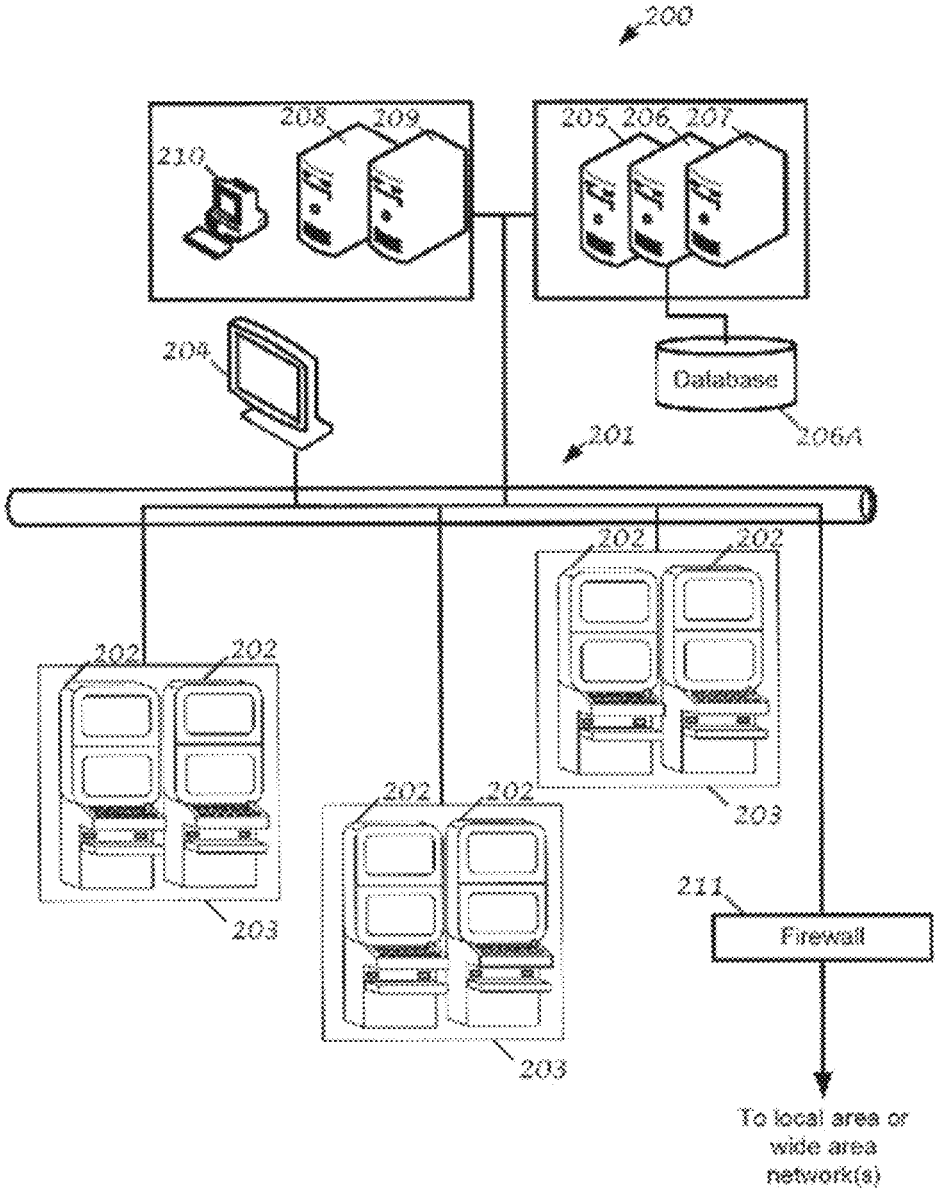
FIG. 18 is a block diagram depicting different examples of networked gaming systems according to some embodiments.

Referring to FIG. 18, a gaming system 200 in accordance with an alternative embodiment includes a network 201, which for example may be an Ethernet network. Gaming machines 202, shown arranged in three banks 203 of two gaming machines 202, are connected to network 201. Gaming machines 202 provide a player operable interface and may be the same as the gaming machines 10, 100 shown in FIGS. 1 and 16, or may have simplified functionality depending on the requirements for implementing game play. While banks 203 of two gaming machines are illustrated in FIG. 18, banks of one, three or more gaming machines are also envisaged.

One or more displays 204 may also be connected to network 201. For example, displays 204 may be associated with one or more banks 203 of gaming machines. Displays 204 may be used to display representations associated with game play on gaming machines 202, and/or used to display other representations, for example promotional or informational material.

In a thick client embodiment, a game server 205 implements part of the game played by a player using a gaming machine 202, and the gaming machine 202 implements part of the game. With this embodiment, as both the game server and the gaming device implement part of the game, they collectively provide a game controller. A database management server 206 may manage storage of game programs and associated data for downloading or access by the gaming machines 202 in a database 206A. Typically, if the gaming system enables players to participate in a Jackpot game, a Jackpot server 207 will be provided to perform accounting functions for the Jackpot game. A loyalty program server 212 may also be provided.

In a thin client embodiment, game server 205 implements most or all of the game played by a player using a gaming machine 202 and the gaming machine 202 essentially provides only the player interface. With this embodiment, game server 205 provides the game controller. The gaming machine will receive player instructions, pass these to the game server which will process them and return game play outcomes to the gaming machine for display. In a thin client embodiment, the gaming machines could be computer terminals, e.g. PCs running software that provides a player interface operable using standard computer input and output components. Other client/server configurations are possible, and further details of a client/server architecture can be found in WO 2006/052213 and PCT/SE2006/000559, the disclosures of which are incorporated herein by reference.

Servers are also typically provided to assist in the administration of gaming system 200, including for example a gaming floor management server 208, and a licensing server 209 to monitor the use of licenses relating to particular games. An administrator terminal 210 is provided to allow an administrator to run network 201 and the devices connected to the network.

Gaming system 200 may communicate with other gaming systems, other local networks, for example a corporate network, and/or a wide area network such as the Internet, for example through a firewall 211.

Persons skilled in the art will appreciate that in accordance with known techniques, functionality at the server side of the network may be distributed over a plurality of different computers. For example, elements may be run as a single "engine" on one server or a separate server may be provided. For example, the game server 205 could run a random generator engine. Alternatively, a separate random number generator server could be provided. Further, persons skilled in the art will appreciate that a plurality of game servers could be provided to run different games or a single game server may run a plurality of different games as required by the terminals.

Further Detail of Gaming System

When credit input mechanism 52.1 (of FIG. 15) has received a physical item representing a monetary value, a credit balance is established. The player may then operate the game play mechanism 56 (of FIG. 15) to specify one or more of a plurality of wagers for the base game and to initiate a play of the base game. In one embodiment, at least certain of the wagers that the player can make entitles the player to win a chance to play feature game 15, for example, when a trigger condition occurs. In some embodiments, when the credit input mechanism 52.1 (of FIG. 15) has received a physical item representing a monetary value for establishing a credit balance, at least a portion of the received physical item may initiate a play of the base game directly.

Figure 19:
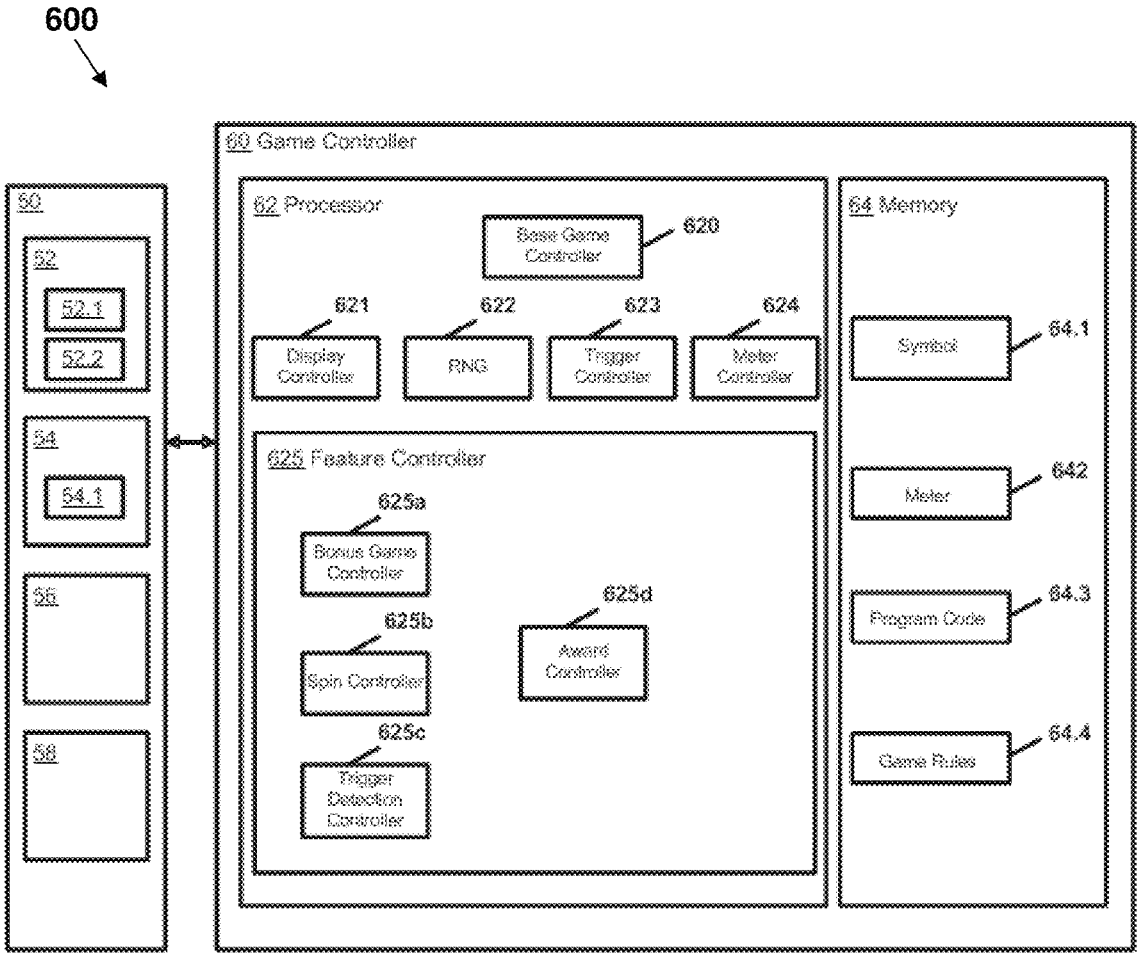
FIG. 19 is a schematic block diagram of core components of the gaming machine of FIG. 1.

Referring now to FIG. 19, gaming machine 600, as described with reference to FIG. 15, includes game controller 60 having processor 62 and memory 64. Memory 64 includes a symbol memory module 64.1 that stores data of a plurality of base game symbols including the special symbols 51 (and including playing cards 27), a meter memory module 64.2 that stores meter data of gaming machine 600, and a program code memory 64.3 that stores program code to implement a number of modules to be executed by processor 62. In the embodiment, memory 64 also includes a game rules memory module 64.4 that stores a plurality of game rules.

Persons skilled in the art will appreciate that some or all of the components of the game controller 60 could be alternatively implemented. For example, in some embodiments, the game controller 60 and its components are implemented in the form of a dedicated circuit, or an individual application-specific-integrated-circuit (ASIC). In other embodiments, game controller 60 and its components is implemented as an individual ASIC. In other embodiments, some or all of the game controller components may be individually or collectively implemented as software modules, controllers, and/or circuitries.

Referring to FIG. 19, processor 62 includes a display controller 621 which is configured to control display 54 and a random number generator (RNG) 622 configured to generate a random number. Processor 62 also includes a meter controller 624 configured to generate meter data, for example, for display or storage based on game play, and/or to read meter data from the meter memory 64.2.

In the embodiment shown, processor 62 includes a base game controller 620 and a feature controller 625, both of which communicate with display controller 621, the RNG 622, and/or the meter controller 624. Base game controller 620 randomly selects symbols from symbol memory 64.1 for display of the base game outcome. As an example, base game controller 620 randomly selects a stop position for each of the five base game reels 37 and then accordingly controls the display of the spinning and stopping of reels 37.

Feature controller 625 includes a bonus game controller **625*a* which controls the population of playing cards 27 (FIG. 2) onto feature wheel 23. Feature controller 625 determines whether a special symbol 51 (FIG. 3) spins up in the base game outcome. The special symbol 51 identifies the playing card 27 that may be populated up to the wheel 23. Bonus game controller 625*a* causes the display to move card 25 up to wheel 23 via display controller 621, in accord with and as indicated by the player in dragging the card, as described above. As an alternative embodiment, and as explained above, bonus game controller 625*a* may move card 27 without any player participation. Also, as described above, feature controller 625 controls the revision of the cards on wheel 23** and the discarding of the cards.

Processor 62 also includes a trigger controller 623. Trigger controller 623 determines whether a trigger event has occurred. For example, a particular game outcome of the base game will serve as a trigger event, or a trigger symbol (not shown) in the base game outcome will serve as a trigger event, or a number of plays of the base game will serve as a trigger event.

Feature controller 625 also includes a trigger detection controller **625*c* which monitors the indication from trigger controller 623 that a trigger event has occurred, and then trigger detection controller 625*c* initiates the feature game. Trigger detection controller 625*c* may also receive a player actuation command signal to initiate the feature game. A spin controller 625*b* causes wheel 23 to spin and stop to select a poker hand, as described above. That developed poker hand is evaluated by an award controller 625*d***.

Figure 20:
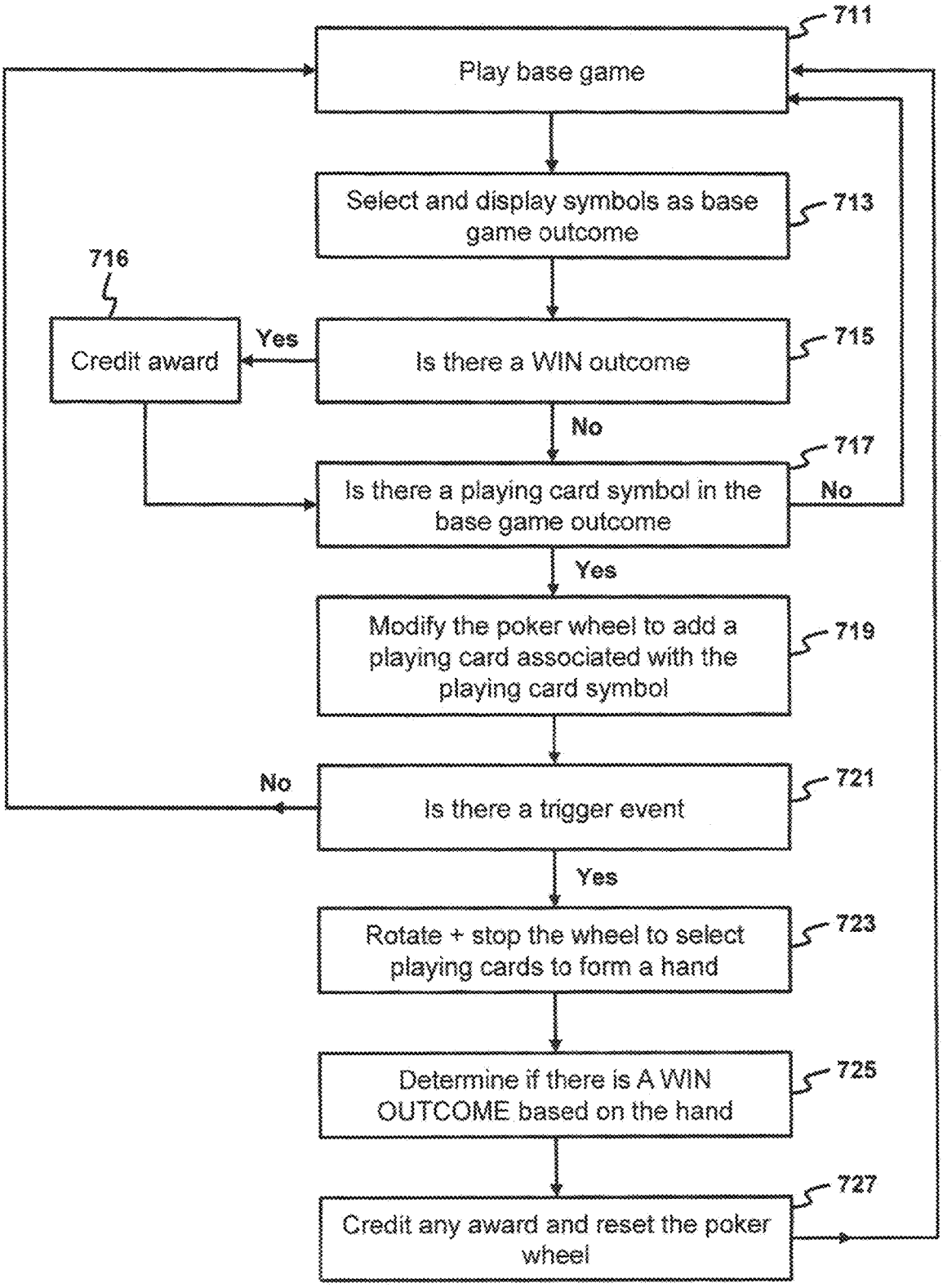
FIG. 20 is a flowchart depicting an example gaming method according to some embodiments.

Referring to FIG. 20, a flowchart is shown of a method of gaming in respect of the embodiments described above. At step 711 the play of each instance of the game is initiated. An instance is the spin and stopping of the base game reels to generate a base game outcome. On initiation of the first instance, the feature wheel is reset, as described above. The beginning of initiation of the first instance of game play may occur by several events, for example, a player places a wager and initiates a play of the game.

At step 713, base game controller 620 (FIG. 19) selects a plurality of symbols and controls video display 14 to display the plurality of symbols at respective display positions 43 (FIG. 2) to form a base game outcome.

At step 715, a WIN outcome is determined by processor 62. Processor 62 makes use of pay tables stored in game rules 64.4 of memory 64 to make the determination of a WIN outcome. If a WIN outcome is determined, credits are awarded to the player at step 716.

At step 717, after determining whether a WIN outcome has occurred, bonus game controller 625*a* determines whether a special symbol 51 has occurred in the base game outcome. If there is no occurrence of a special symbol, the first instance of the base game is completed and return is made to step 711. At step 711, following a play of the first instance, base game controller determines interaction activity by the player (for example, the player places a wager and initiates play of the game) in order to initiate play of the next game instance.

However, if a determination is made at step 717 that a special symbol has occurred in the base game outcome, then the feature wheel 23 is modified at step 719. As described above, the player has several options in modifying the feature wheel including adding to the wheel the particular playing card corresponding to the playing card symbol that turned up in the base game, including adding the card at a blank area of the wheel or replacing a card already on the wheel. Otherwise, at step 719 the player may merely discard the playing card corresponding to the special symbol. The player may also change positions of the playing cards already positioned on the wheel. Where bonus game controller 625*a* automatically performs step 719, bonus game controller 625*a* places the playing card in a blank wheel area randomly selected.

Where at step 719, bonus game controller 625*a* automatically places the card on wheel 13, bonus game controller 625*a* may determine the position on the wheel where the playing card is to be placed, based on the particular cards on the wheel and the location of the particular cards. For example, if the playing card is an 8 of hearts, and there are presently four heart cards adjacent one another on the wheel, bonus game controller 625*a* places the 8 of hearts card adjacent to the four heart cards.

At step 721, trigger controller 623 determines if a trigger event has occurred which will trigger the feature game. For example, a particular base game outcome, e.g., four "A's' will cause play of the feature wheel at step 723.

The trigger event determination is monitored by trigger detection controller 625*c* and the feature wheel is caused to spin and stop by spin controller 625*b*. The stopping position of the feature wheel relative to indicator 35 will cause a selection of five cards to form a hand.

At step 725, processor 62 determines whether the formed hand is a WIN outcome in view of a pay table in memory 64.4. The pay table identifies the hands that pay credits and the number of credits to be awarded for such hands.

At step 727, the processor awards the player credits according to the pay table determination. Whether credits are awarded or not, return is made to step 711 where a first game instance is begun and the feature wheel is reset.

Further aspects of the apparatus and method will be apparent from the above description of the system. It will be appreciated that at least part of the method will be implemented electronically, for example, digitally by a processor executing program code such as in the above description of a game controller.

In this respect, in the above description certain steps are described as being carried out by a processor of a gaming system, it will be appreciated that such steps will often require a number of sub-steps to be carried out for the steps to be implemented electronically, for example due to hardware or programming limitations. For example, to carry out a step such as evaluating, determining or selecting, a processor may need to compute several values and compare those values.

As indicated above, the method may be embodied in program code. The program code could be supplied in a number of ways, for example on a tangible computer readable storage medium, such as a disc or a memory device, e.g. an EEPROM, (for example, that could replace part of the memory) or as a data signal (for example, by transmitting it from a server). Further different parts of the program code can be executed by different devices, for example in a client server relationship. Persons skilled in the art will appreciate that program code provides a series of instructions executable by the processor.

It will be understood to persons skilled in the art of the invention that many modifications may be made without departing from the spirit and scope of the invention. In particular, it will be apparent that certain features of embodiments of the invention can be employed to form further embodiments. For example, higher paid hand card orders may be weighted differently than lower paid hand card orders. In an embodiment, higher paid hand card orders are weighted lower than lower paid hand card orders.

It is to be understood that, if any prior art is referred to herein, such reference does not constitute an admission that the prior art forms a part of the common general knowledge in the art in any country.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

Numerous embodiments are described in this disclosure, and are presented for illustrative purposes only. The described embodiments are not, and are not intended to be, limiting in any sense. The presently disclosed invention(s) are widely applicable to numerous embodiments, as is readily apparent from the disclosure. One of ordinary skill in the art will recognize that the disclosed invention(s) may be practiced with various modifications and alterations, such as structural, logical, software, and electrical modifications. Although particular features of the disclosed invention(s) may be described with reference to one or more particular embodiments and/or drawings, it should be understood that such features are not limited to usage in the one or more particular embodiments or drawings with reference to which they are described, unless expressly specified otherwise.

The foregoing description discloses only exemplary embodiments of the invention. Modifications of the above disclosed apparatus and methods which fall within the scope of the invention will be readily apparent to those of ordinary skill in the art. For example, although the examples discussed above are illustrated for a gaming market, embodiments of the invention can be implemented for other markets.

Accordingly, while the present invention has been disclosed in connection with exemplary embodiments thereof, it should be understood that other embodiments may fall within the spirit and scope of the invention, as defined by the following claims.

What is claimed is:

1. A non-transitory computer-readable medium for conducting a game on a gaming system, readable by at least one processor and comprising instructions stored thereon to cause the at least one processor to:

randomly determine a first set of symbols to be displayed on one or more reels, wherein the first set of symbols represents a base outcome for the one or more reels based on one or more random numbers from a random number generator;

populate wheel areas of a wheel with a selection of a first symbol from the first set of symbols and a skilled placement of the first symbol selected into one of the wheel areas via a drag and drop movement on a touch screen;

determine a second outcome for the wheel formed from the first symbol placed; and determine one or more payout amounts based on the base outcome for the one or more reels and the second outcome for the wheel.

2. The non-transitory computer-readable medium of claim 1, wherein the first symbol is a special symbol selected from the first set of symbols.

3. The non-transitory computer-readable medium of claim 2, wherein the instructions further cause the at least one processor to randomly determine a placement of the special symbol in the one of the wheel areas of the wheel when the skilled placement does not occur within a predetermined amount of time.

4. The non-transitory computer-readable medium of claim 2, wherein the instructions further cause the at least one processor to randomly replace a preexisting symbol in the one of the wheel areas of the wheel with the special symbol.

5. The non-transitory computer-readable medium of claim 2, wherein the special symbol represents one of a plurality of playing card symbols in the wheel.

6. The non-transitory computer-readable medium of claim 1, wherein the instructions further cause the at least one processor to allow the first symbol to be selectable based on a combination of symbols within the first set of symbols.

7. The non-transitory computer-readable medium of claim 1, wherein the instructions further cause the at least one processor to reset one or more wheel areas of the wheel in response to satisfying a game condition.

8. The non-transitory computer-readable medium of claim 7, wherein the game condition corresponds to detecting that a player tracking card has been removed from a gaming machine.

9. The non-transitory computer-readable medium of claim 7, wherein the game condition corresponds to performing a set number of reel spins for a base game.

10. The non-transitory computer-readable medium of claim 7, wherein the game condition corresponds to a detecting that a set time period has elapsed since a last reel spin.

11. The non-transitory computer-readable medium of claim 1, wherein the base outcome for the one or more reels provides a separate payout from the second outcome for the wheel.

12. A non-transitory computer-readable medium for conducting a game on a gaming system, readable by at least one processor and comprising instructions stored thereon to cause the at least one processor to:

present a first set of display symbols on at least one reel, wherein the first set of display symbols represents a first determined outcome for the at least one reel based on at least one random number from a random number generator;

receive a selection of a first display symbol from the first determined outcome;

receive a skilled placement of the first display symbol selected in one of a plurality of wheel areas of a wheel via a drag and drop movement on a touch screen;

display a second determined outcome for the wheel, wherein the second determined outcome for the wheel is based on the first display symbol placed; and present at least one payout amount based on the first determined outcome for the one or more reels and the second determined outcome for the wheel.

13. The non-transitory computer-readable medium of claim 12, wherein the first display symbol is a special display symbol in the first set of display symbols, and wherein the first display symbol of the wheel corresponds to the special display symbol.

14. The non-transitory computer-readable medium of claim 13, wherein the instructions further cause the at least one processor to present the special display symbol randomly in the one of the plurality of wheel areas of the wheel when the skilled placement does not occur within a predetermined amount of time.

15. The non-transitory computer-readable medium of claim 13, wherein the instructions further cause the at least one processor to randomly replace an existing display symbol presented in the one of the plurality of wheel areas of the wheel with the special display symbol.

16. The non-transitory computer-readable medium of claim 12, wherein the first set of display symbols and the plurality of wheel areas are presented simultaneously on the touch screen.

17. A method for generating an outcome on a gaming device, the method comprising:

randomly determining a first set of symbols to be displayed on one or more reels, wherein the first set of symbols is indicative of a first outcome for the one or more reels based on one or more outcomes from a random number generator;

receiving a selection of a special symbol from the first outcome and a skilled placement of the special symbol selected into at least one wheel area of a plurality of wheel areas of a wheel via a drag and drop movement on a touch screen;

determining a second outcome for the wheel based on the special symbol placed; and determining one or more payout amounts based on the first outcome for the one or more reels and the second outcome for the wheel.

18. The method of claim 17, further comprising randomly determining a placement of the special symbol in the at least one wheel area of the plurality of wheel areas of the wheel when the skilled placement does not occur within a predetermined amount of time.

19. The method of claim 17, further comprising resetting one or more of the plurality of wheel areas of the wheel in response to satisfying a game condition.

20. The method of claim 17, further comprising randomly replacing an existing symbol in the at least one wheel area of the wheel with the special symbol.

* * * * *